US006605422B2

(12) United States Patent
Urabe

(10) Patent No.: US 6,605,422 B2
(45) Date of Patent: Aug. 12, 2003

(54) PROCESS FOR PRODUCING A SILVER HALIDE PHOTOGRAPHIC EMULSION

(75) Inventor: Shigeharu Urabe, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/098,402

(22) Filed: Mar. 18, 2002

(65) Prior Publication Data

US 2003/0039931 A1 Feb. 27, 2003

(30) Foreign Application Priority Data

Mar. 16, 2001 (JP) ..... P2001-076564

(51) Int. Cl.[7] ..... G03C 1/015
(52) U.S. Cl. ..... 430/569
(58) Field of Search ..... 430/569

(56) References Cited

U.S. PATENT DOCUMENTS 5,104,786 A 4/1992 Chronis et al.

FOREIGN PATENT DOCUMENTS

WO WO 00/62913 A1 10/2000
WO WO 00/62914 A1 10/2000

*Primary Examiner*—Hoa Van Le
(74) *Attorney, Agent, or Firm*—Sughrue Mion, PLLC

(57) ABSTRACT

A process for producing a silver halide emulsion is disclosed, which comprises disposing a mixer equipped with a first channel and a second channel brought into partial contact therewith; and allowing a silver salt solution (Fluid 1) and a halide solution (Fluid 2) to pass through said first channel and said second channel, respectively, to thin said two fluids into lamellae having an open interface therebetween and having a thickness of 1 to 500 $\mu$m in a normal line direction on the contact interface, thereby inducing diffusion, transfer and reaction of silver ions and halogen ions between said two thin layers, and thus forming silver halide grains continuously.

5 Claims, No Drawings

PROCESS FOR PRODUCING A SILVER HALIDE PHOTOGRAPHIC EMULSION

FIELD OF THE INVENTION

The present invention relates to a process for producing a silver halide photographic emulsion for photosensitive materials.

BACKGROUND OF THE INVENTION

Silver halide photographic emulsions are usually produced by charging silver ions and halide ions in a reaction vessel equipped with a stirrer. Initial charging causes nucleation, while further addition causes crystal growth. Stirring is effected by various methods as described in Japanese Patent Application (Laid-Open) Nos. 219092/1995, 171156/1996 and 283741/1992, Japanese Patent Publication 22739/1996, and U.S. Pat. No. 3,782,954. When nucleation is caused by such methods, however, circulation of the emulsion in the reaction vessel causes nucleus formation and nucleus growth simultaneously even by adopting any one of the above-described stirring methods, thereby making it difficult to form a mono-disperse nucleus.

In the silver halide photographic fields, tabular silver halide grains having a large light receiving area as a photosensitive element have been used widely. Use of tabular silver halide grains having a small thickness is preferred in order to heighten the light receiving efficiency. The above-described process is however accompanied by such a drawback that tabular silver halide grains during growth pass through a supersaturated region in the vicinity of the adding port of silver ions or halide ions, leading to an increase in the thickness of the tabular grains.

In Japanese Patent Publication No. 82208/1995 or 23218/1995, disclosed is a countermeasure against such a drawback by disposing an external mixer outside the reaction vessel, forming silver halide fine grains in the external mixer and using them for the nucleus formation or growth step. In this process, an aqueous solution of a silver salt, an aqueous solution of a halide salt and an aqueous solution of a dispersion medium are charged in the external mixer to form fine grains continuously. These fine grains can be used for nucleus formation and/or growth. This external mixer is desired to be able to completely mix the added solutions as fast as possible. Necessity of long hours for mixing or circulation of the added solutions in the external mixer is not preferred.

As the reaction vessel, various types are usable. In U.S. Pat. No. 5,250,403 or Japanese Patent Application (Laid-Open) No. 43570/1998, mixing is conducted by a stirring blade equipped in a mixer having a small capacity. In such a process, however, the added solutions circulate inside of the mixer.

In Japanese Patent Application (Laid-Open) No. 139440/1992 or International Patent Publication No. 507255/1994, mixing is conducted without mechanical stirring so that this process is free from the problem of circulation of added solutions. This process is however insufficient in mixing power, because it does not include stirring. In order to maintain a sufficient mixing power even without mechanical stirring, a process of mixing the added solutions by making use of the kinetic energy of their jet stream has been proposed. In Japanese Patent Application (Laid-Open) No. 334848/1996, disclosed is a process for producing a silver halide photographic emulsion by using such a kinetic energy of a jet stream. This however relates to a process for producing a silver halide photographic emulsion by a single jet method and entirely differs from the process using an external mixer. Moreover, the kinetic energy used here is insufficient for complete mixing of the solutions in the reaction vessel and mechanical stirring is used in combination. In Japanese Patent Application (Laid-Open) 2000-338620, disclosed is a process of mixing an aqueous solution of a silver salt and an aqueous solution of a halide within a short time by forming at least one of these solutions into a high-speed linear jet stream. By this process, a high kinetic energy contributes to mixing and the problems of the circulation of the added solutions can be overcome, but this process involves such a drawback as unstable flow rate because high pressure is necessary for the formation of a jet stream.

SUMMARY OF THE INVENTION

An object of the present invention is to provide a process for producing a silver halide emulsion capable of producing mono-disperse silver halide grains by using, as nuclei, small-sized, mono-disperse silver halide grains continuously formed. Another object of the present invention is to provide a process for producing a silver halide emulsion by using these mono-disperse silver halide grains for crystal growth, thereby forming thin tabular silver halide grains.

These objects can be attained by the below-described processes.

[1] A process for producing a silver halide emulsion, which comprises disposing a mixer equipped with a first channel and a second channel brought into partial contact therewith; and allowing a silver salt solution (Fluid 1) and a halide solution (Fluid 2) to pass through said first channel and said second channel, respectively, to thin said two fluids into lamellae having an open interface therebetween and having a thickness of 1 to 500 $\mu$m in a normal line direction on the contact interface, thereby diffusing, transferring and reacting silver ions and halogen ions between said two thin layers, and thus forming silver halide grains continuously.

[2] The process as described in [1], wherein the first channel and the second channel are disposed in parallel and alternately and the number of the channels is 3 or greater.

[3] A process for producing a silver halide emulsion, which comprises feeding a fine-grain silver halide emulsion prepared by a process as described in [1] or [2] to a reaction vessel for causing nucleation and/or grain growth, and thereby causing nucleation and/or grain growth in the reaction vessel.

[4] A process for preparing a silver halide emulsion, which comprises disposing at least one mixer as described in [1], in circulating loop for circulating a dispersion medium solution in a reaction vessel to the reaction vessel and outside the reaction vessel, and charging a silver salt solution and/or a halogen salt solution in mixer, thereby inducing nucleation and/or grain growth.

[5] The process as described in [3], wherein the fine grains of the silver halide emulsion has an aspect ratio of 5 or greater.

The preparation process of the present invention makes it possible to form a silver halide photographic emulsion made of tabular grains having a high aspect ratio and narrow grain size distribution.

DETAILED DESCRIPTION OF THE INVENTION

As the halide salt solution of the present invention, an aqueous solution of potassium bromide, sodium bromide, potassium chloride, sodium chloride, potassium iodide or sodium iodide or mixture thereof is generally used. When silver halide grains available by the process of the present invention are used as a nucleus, the aqueous solution preferably has a concentration of 4 mol/L or less, more preferably 1 mol/L less, with 0.2 mol/L or less being most preferred. When they are used for crystal growth, a highly concentrated aqueous solution is preferred from the viewpoint of productivity. A concentration of 0.5 mol/L or greater but not greater than 4 mol/L, more preferably 1.0 mol/L or greater is preferred. The temperature of the aqueous solution is preferably 5° C. or greater but not greater than 75° C.

It is preferred that at least one of the silver salt solution and halide salt solution of the present invention contains gelatin as a protective colloid. Gelatin has a large influence on the probability of twin crystal formation in the resulting silver halide grains so that a preferred concentration of the aqueous gelatin solution varies, depending on the using purpose of the fine silver halide grains thus formed. When continuously formed silver halide grains are used as a nucleus for the preparation of tabular silver halide grains, parallel double twin nuclei are necessary so that the concentration of the aqueous gelatin solution must be controlled to attain a desired probability of twin crystal formation. It is preferred to select the gelatin concentration so that the amount of gelatin per 1 g of silver in a mixture of an aqueous solution of a silver salt and an aqueous solution of a halide salt would be 0.03 g or greater but not greater than 0.4 g, with a gelatin amount of 0.3 g or less being more preferred. When the continuously formed silver halide grains are used as nuclei for the preparation of normal crystal grains, it is necessary to increase the gelatin concentration upon nucleation in order to decrease the probability of the twin crystal formation as much as possible. The gelatin amount per g of silver nitrate is preferably 0.4 g or greater (no upper limitation is imposed, but preferably, not greater than 50 g), more preferably 1 g or greater, still more preferably 5 g or greater.

The fine-grain silver halide emulsion available by the present invention is usable upon crystal growth of silver halide grains. When it is used for crystal growth, dissolution of the silver halide grains as soon as their addition is preferred. For this, twin crystals as less as possible, in other words, a higher concentration of the aqueous gelatin solution is preferred. The concentration of the aqueous gelatin solution is adjusted by adding gelatin in an amount of 0.2 g or greater but not greater than 1 g per g of silver nitrate. Amounts of 0.3 g or greater are more preferred, with 0.4 g or greater being most preferred.

When the concentration of aqueous gelatin solution is set high, its viscosity increases, disturbing smooth addition. Its viscosity can be decreased by lowering the molecular weight of gelatin by enzyme-decomposition or the like. Gelatin preferably has a molecular weight of 5,000 or greater but not greater than 100,000, more preferably 50,000 or less, most preferably 30,000 or less. When gelatin is used for crystal growth, gelatin to be added together with silver halide grains has an influence on the thickness of the tabular silver halide grains. The influence on the thickness can be changed variously by chemical modification of gelatin. Oxidation, succination or trimellitation treatment is preferred for obtaining thin tabular silver halide grains.

A number of processes have so far been proposed for forming silver halide grains constituting a silver halide emulsion. In a process employed industrially now, an aqueous solution of silver nitrate and an aqueous solution of a halogen salt are added, under vigorous stirring, to a dispersion medium solution (aqueous solution of a protective colloid) typified by gelatin and they are mixed as rapid as possible to form silver halide grains. Reaction of silver ions with halogen ions to form a silver halide proceeds very rapidly so that rapid stirring and mixing of these two ion solutions in a short time is indispensable for uniform reaction. Stirring can be conducted by various methods as described in Japanese Patent Application (Laid-Open) Nos. 219092/1995, 171156/1996 and 283741/1992, Japanese Patent Publication No. 22739/1996 and U.S. Pat. No. 3,782,954. In these processes, a propeller type or blade type stirrer is rotated at a high speed in a reaction vessel to cause swirls. While these swirls are divided into many small swirls, the solutions can be mixed. Such a mixing is called "mixing by turbulent flow" and details of this method have so far been studied. This process of adding an aqueous solution of a silver salt and an aqueous halide solution to a dispersion medium in a reaction vessel having a stirrer equipped therein is however accompanied with the drawback that upon nucleation, nuclei once formed circulate in the reaction vessel, thereby simultaneously causing so-called local recycling and their growth.

As a countermeasure against this problem, a process of disposing an external mixer outside the reaction vessel, forming fine silver halide grains in the external mixer and using them for nucleation or crystal growth step is proposed. In this process, a silver salt solution, a halide salt solution and a dispersion medium solution are charged in the external mixer to continuously form fine grains. The resulting fine grains are usable for nucleus formation and/or growth. The external mixer is desired to be able to completely mix the added solutions as fast as possible. Mixing for long hours or circulation of the added solutions within the external mixer is not preferred. Various types of such a reaction vessel have been proposed. In U.S. Pat. No. 5,250,403 or Japanese Patent Application (Laid-Open) No. 43570/1998, mixing with a stirring blade in a mixer having a small capacity is disclosed. The circulation of the added solutions inside of the mixer cannot be prevented even by this process. This process uses, as a mixing principle, a turbulent flow. Another mixing process is to make use of the kinetic energy of the jet stream of the added solutions in order to keep a sufficient mixing power without mechanical stirring. In Japanese Patent Application (Laid-Open) No. 334848/1996, disclosed is a process for producing a silver halide photographic emulsion making use of the kinetic energy of such a jet stream. This also adopts, as the mixing principle, a turbulent flow induced by the jet stream having a high kinetic energy.

In the conventional mixing depending on a turbulent flow, a whirl formed by stirring is divided into small whirls and in the final stage, diffusion occurs among these small whirls, which actualizes mixing. After formation of a large whirl, however, the divided whirls cannot be controlled technically and the subsequent progress is left alone. Nothing is known about the size or distribution of whirls when the ion or molecular diffusion occurs in the final stage and no technique has been developed to control it.

The mixing for the formation of silver halide grains in the present invention is not the conventional mixing by a turbulent flow but mixing utilizing a laminar flow. In the mixing in the present invention, more prompt and more uniform mixing is achieved by dividing the silver nitrate solution and halide solution into thin layers (lamellae), and bringing them in contact at wider areas, thereby causing uniform ion diffusion in a short time. The transfer of ions due to diffusion can be determined by the below-described formula as the product of a diffusion coefficient and a concentration gradient in accordance with the Fick's low associating it with the time-dependent change of the concentration.

$$t \sim dl^2/D$$

(i.e., t is proportional to $dl^2/D$)

wherein, D represents a diffusion constant, dl represents the thickness of a thin layer and t represents a mixing time.

It can be understood from the formula that the mixing time t is proportionate to the square of the thickness of a thin layer dl so that the mixing time can be shortened effectively by thinning this layer.

The present invention realizes its expected effects by using a microreactor manufactured by IMM (Institute fur Mikrotechnik Mianz). In Chapter 3 of "Microreactor" (W. Ehrfeld, W. Hessel, H. Loewe, 1Ed. (2000) WILEY-VCH), the microreactor is described in detail. It uses, as a principle, multilamination of a fluid, followed by mixing via diffusion. The silver salt solution and halide solution pass through slits having a thickness of several ten micron order and is divided into a number of thin-film fluids. At the outlets of the slits, these divided fluids are brought into contact each other in a wide area in the traveling and normal-line direction. Immediately thereafter, diffusion of silver ions and halogen ions start and mixing via diffusion is completed in a short time. By the ion reaction which has occurred simultaneously, fine silver halide grains are formed.

The thickness of the thin layer in the present invention is 1 $\mu$m or greater but not greater than 500 $\mu$m, preferably 1 $\mu$m or greater but not greater than 100 $\mu$m, more preferably 1 $\mu$m or greater but not greater than 50 $\mu$m, in the traveling and normal-line direction. The mixing time in the present invention by utilizing a laminar flow is less than 0.5 sec, preferably less than 100 msec, more preferably less than 50 msec.

The microreactor to be used in the present invention is an apparatus having a channel of an equivalent diameter of 1 mm or less. The term "equivalent diameter" as used herein is also called corresponding diameter and is a term used in the field of mechanical engineering. When, relative to a pipe having any desired cross-section, an equivalent circular pipe is supposed, the diameter of the equivalent circular pipe is called "equivalent diameter" and is defined by $D_{eq}=4A/p$ wherein A represents the cross-section area of the pipe and p stands for wetted perimeter (length) of the pipe (circumferential length). When this term is applied to a circular pipe, this equivalent diameter coincides with the diameter of the circular pipe. The equivalent diameter is used for presumption of fluidity (properties) or heat transfer properties of the pipe based on the data of equivalent circular pipe and it indicates space scale (typical length) of the phenomenon. The equivalent diameter is $d_{eq}=4a^2/4a=a$ in the case of a pipe with a regular tetragon cross-section whose side is a, $d_{eq}=a/3^{1/2}$ in the case of a pipe with a regular triangle cross-section whose side is a, and $d_{eq}=2h$ in the case of a flow between parallel plates having a channel height of h (refer to "Mechanical Engineering Dictionary", ed. by the Japan Society of Mechanical Engineers, 1997, published by Maruzen).

The channels of the present invention are formed on a solid substrate by a micro-fabrication technique. Examples of the material usable here include metals, silicon, Teflon, glass, ceramics and plastics. When heat resistance, pressure resistance or solvent resistance is required, metals, silicon, Teflon, glass and ceramics are preferably employed. Among these, metals is particularly preferred. Specific examples of the metal include nickel, aluminum, silver, gold, platinum, tantalum, stainless, hastelloy (Ni—Fe alloy) and titanium, of which stainless, hastelloy and titanium are preferred because of high corrosion resistance. In the conventional batch-type reaction apparatus, that having a glass-lined metal (stainless or the like) surface is used when an acid substance is treated. The metal surface coated with glass may be used for the microreactor. Depending on the using purpose, not only glass but also another metal or another material may be coated to the metal surface. Alternatively, a metal or glass is coated to a material (ex. ceramic) other than a metal.

Typical examples of the micro-fabrication technique for manufacturing a channel include LIGA technique using X-ray lithography, high-aspect-ratio photolithography using EPON SU-8, micron-level electrical discharge machining ($\mu$-EDM), Deep RIE silicon etching with high aspect ratio, Hot Embossing, rapid prototyping, laser processing, ion beam processing and mechanical micro-cutting by using a micro-cutting tool made of a hard material such as diamond. These techniques may be used either singly or in combination. Of these, preferred are LIGA technique using X-ray lithography, high-aspect-ratio photolithography using EPON SU-8, micron-level electrical discharge machining ($\mu$-EDM) and mechanical micro-cutting.

When the microreactor of the present invention is fabricated, joining technique is often employed. The ordinarily employed joining method can be classified roughly into solid-phase joining and liquid-phase joining. Typical examples of the usually employed joining method include, as the former one, pressure welding and diffusion joining and as the latter one, welding, eutectic joining, soldering and adhesion. Upon fabrication, a highly precise joining method which does not permit destruction of micro-structures such as channels due to a quality change or large deformation of a material by heating at high temperatures; and having constant size accuracy is desired. Examples of such a technique include silicon direct joining, anodic joining, surface activation joining, direct joining using hydrogen joining, joining using an aqueous HF solution, Au-Si eutectic joining and void-free adhesion.

The equivalent diameter of the channel to be used in the present invention is 1 mm or less, preferably 10 to 500 $\mu$m, especially 20 to 300 $\mu$m. Although no particular limitation is imposed on the length of the channel, it preferably ranges from 1 mm to 1000 mm, especially 10 mm to 500 mm.

The number of the channel usable in the present invention is not limited to one but numbering-up of plural channels is carried out as needed to increase their processing amount.

The reaction in the present invention proceeds while flowing in the channel, that is, in the flow.

The channel of the microreactor to be used in the present invention may be subjected to surface treatment depending on the using purpose. Particularly when an aqueous solution is processed, surface treatment is important to avoid occurrence of an adsorption problem of a sample to glass or silicon. It is desired to actualize flow control in the microsize channel without installing a movable part requiring complex manufacturing process. For example, the fluid operation can be actualized by treating the surface of the channel to form therein hydrophilic and hydrophobic regions and making use of a difference in surface tension acting on the boundary of these regions.

A fluid control function is necessary for introduction of a reagent or sample into the microsized channel of a microreactor and mixing therein. The behavior of a fluid in a microsized region is different from that in a macroscale so that a control system suited for microscale must be considered. The fluid control system can be classified into continuous flow system and liquid droplet (liquid plug) system from the morphological viewpoint, while it can be classified into electrically driven system and pressure driven system from the viewpoint of a driving force. These systems will next be described more specifically. The most widely used system for treating a liquid is the continuous flow system. In the continuous flow system, it is the common practice to fill the channel of the microreactor with a fluid and to drive the whole liquid by a pressure source such as syringe pump prepared outside the microreactor. This continuous flow system has such a merit that the control system can be operated by a relatively simple set-up. It is not suited for operation requiring several reaction steps or exchange of a sample and it has difficulties such as small freedom of system constitution and a large dead volume because the medium to be driven is a solution. The droplet (liquid plug) system is a system different from the continuous flow system. In this droplet system, droplets separated apart by the air are driven inside of the reactor or in a channel leading to the reactor. The droplets are each driven by an air pressure. Such a reactor system must be equipped therein with a vent structure to release the air between the liquid droplet and channel wall or between liquid droplets out of the system as needed and a valve structure to maintain the pressure of the branched channel independently from the pressure of another part. Moreover, it is necessary to build, outside of the reactor, a pressure control system having a pressure source or switchover valve in order to operate droplets while controlling the pressure difference. In such a droplet system, the apparatus or reactor must have a slightly complex structure but multi-stage operations can be carried out, for example, several reactions can be effected successively by individually operating a plurality of liquid droplets. Thus, the freedom of the system constitution becomes larger.

As a driving system for liquid control, widely and usually employed are an electrical driving method of applying a high voltage to both ends of a channel, thereby generating an electro-osmosis flow and transferring the liquid by using this flow; and a pressure driving method of applying a pressure to a liquid from a pressure source prepared outside, thereby transferring it. A difference between these two methods, for example, in the behavior of a fluid, is known that the flow rate profile in the cross-section of the channel becomes a flat distribution in the former case, while it exhibits a hyperbolic curve with a high flow rate at the central part of the channel and a low flow rate on the wall surface portion. The electrical driving system is suited for the transfer while keeping the shape of a sample plug. In the electrical driving system, the continuous flow system must be adopted because the channel must be filled with a fluid. Since the fluid can be operated by the electrical control, relatively complex treatments, for example, formation of a time-dependent concentration gradient by successively changing a mixing ratio of the two solutions can be actualized. The pressure driving system, on the other hand, can be applied widely, because the substrate is almost free from the influence of this system, for example, the fluid can be controlled irrespective of its electrical properties and subsidiary effects such as heat generation or electrolysis can be neglected. On the contrary, it needs disposal of a pressure source outside of the reactor and automation of a complex operation, because the response characteristics of the operation change depending on the size of a dead volume of the pressure system.

The liquid control method is selected as desired depending on the using purpose, but the continuous flow system driven by pressure is preferred.

The temperature of the microreactor may be adjusted by putting the whole apparatus in a temperature-controlled container; or by using, for heating, a heater structure such as metallic resistance wire or polysilicon integrated in the apparatus and, for cooling, a thermal cycle with natural cooling. In the case of the metallic resistance wire, as the temperature sensing, the temperature is detected based on fluctuations in the resistance of another resistance wire formed similar to that of the heater, while in the case of polysilicon, it is is detected using a thermocouple. Heating or cooling may be conducted from the outside of the reactor by bringing a Peltier device in contact with the reactor. An appropriate method is selected from the above-described systems in consideration of the using purpose or materials constituting the reactor.

A method of disposing a mixer in a circulating loop capable of circulating, to the outside of a reaction vessel, a dispersion medium solution in the reaction vessel, and adding an aqueous solution of a silver salt and/or an aqueous solution of a halogen salt to the mixer, thereby causing nucleation and/or grain growth and thus preparing a silver halide emulsion is described in Japanese Patent Publication 21045/1973, and U.S. Pat. No. 3,897,935, European Patent Nos. 779537 and 779538. Even in this process for preparing a silver halide emulsion, use of a microreactor as the mixer is effective. Use of one microreactor makes it possible to add an aqueous solution of silver nitrate or an aqueous solution of a halogen salt to the mixer and mixing it with a silver halide emulsion circulated from the reactor. When two microreactors are connected in series, an aqueous solution of silver nitrate and an aqueous solution of a halogen salt can be added to each of the two microreactors. Disposal of a plurality of the circulating loops and equipment of each loop with a microreactor make it possible to add and mix an aqueous solution of silver nitrate and/or an aqueous solution of a halogen salt in parallel.

A description will next be made of emulsion grains formed in the final stage. The emulsion grains available finally by the present invention may be regular crystal grains such as steric grains, octahedral grains, tetradecahedral grains and eicosahedral grains, but tabular grains are preferred. The tabular grains have preferably an average grain size (equivalent sphere diameter) of 0.1 to 5.0 $\mu$m, with 0.2 to 3.0 $\mu$m being especially preferred. The diameter of a circle equivalent to the projected area of the tabular grains (equivalent circle diameter) is preferably 0.3 to 30 $\mu$m, with 0.5 to 10.0 $\mu$m being especially preferred. The thickness is preferably 0.1 $\mu$m or less, more preferably 0.05 $\mu$m or less (preferably 0.0001 $\mu$m or greater). The diameter/thickness ratio (aspect ratio) is preferably 5 or greater but not greater than 1,000, with 10 or greater but not greater than 300 being especially preferred.

The silver halide grains of the present invention may have poly-disperse or mono-disperse grain size distribution, but the mono-disperse distribution is preferred.

The grains of the present invention may have a uniform structure or a so-called core/shell structure formed of a core and a shell surrounding the core. Alternatively, they may be multi-structure grains having, between the core and shell, at least one phase different in a halogen composition.

The halide of the emulsion available by the present invention may any one of silver bromide, silver chloride, silver iodobromide, silver chlorobromide, silver chloroiodobromide and silver chloroiodide. In any composition, silver halide grains having a microscopically uniform distribution are available. This is particularly marked in the case of mixed crystals. Even if grains have a single halogen composition as pure silver bromide or pure silver chloride, they are formed without local existence of a silver excessive region so that so-called impurities such as silver nucleus are not introduced and uniform grains are available. For the formation of mixed crystals, fine grains for growth having a halogen composition corresponding to the target halogen composition is supplied.

The gelatin usable for preparing the emulsion of the present invention may be subjected to various modifications as described below. Examples of the modified gelatin include phthalated gelatin having a modified amino group, succinated gelatin, trimellited gelatin, pyromellited gelatin, esterified gelatin having a modified carboxyl group, amidated gelatin, formylated gelatin having a modified imidazole group, oxidized gelatin having a decreased methionine (group) content and reduced gelatin having an increased methionine (group) content.

Another hydrophilic colloid can also be used instead.

Examples thereof include proteins such as gelatin derivatives, graft polymers of gelatin and another high molecule, albumin and casein; cellulose derivatives such as hydroxyethyl cellulose, carboxymethyl cellulose, and cellulose sulfates; sugar derivatives such as sodium alginate and starch derivatives; and a variety of synthetic hydrophilic high molecular substances such as homopolymers and copolymers, e.g., polyvinyl alcohol, partially acetalized polyvinyl alcohol, poly-N-vinylpyrrolidone, polyacrylic acid, polymethacrylic acid, polyacrylamide, polyvinylimidazole, and polyvinylpyrazole. As the gelatin, acid-processed gelatin and enzyme-processed gelatin as described in Bull. Soc. Sci. Photo. Japan. No. 16, page 30 (1966), as well as lime-processed gelatin are also usable. In addition, hydrolyzed or enzyme-decomposed products of gelatin can also be used.

Dyes usable for the emulsion of the present invention include cyanine dyes, merocyanine dyes, composite cyanine dyes, composite merocyanine dyes, holopolar cyanine dyes, hemicyanine dyes, styryl dyes, and hemioxonol dyes. Dyes belonging to the cyanine dyes are especially useful. Any nucleus ordinarily used for cyanine dyes as a basic heterocyclic nucleus can be applied to these dyes. Examples include pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; these nuclei each having an alicyclic hydrocarbon ring fused thereto; and these nuclei having an aromatic hydrocarbon ring fused thereto such as indolenine nucleus, benzindolenine nucleus, indole nucleus, benzoxadole nucleus, naphthoxazole nucleus, benzothiazole nucleus, naphthothiazole nucleus, benzoselenazole nucleus, benzimidazole nucleus, and quinoline nucleus. These nuclei may have, on the carbon atom thereof, a substituent.

These sensitizing dyes may be used either singly or in combination. The sensitizing dyes are often used in combination for the purpose of supersensitization. Representative examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents Nos. 1,344,281 and 1,507,803, Japanese Patent Publication Nos. 4936/1968 and 12375/1978, and Japanese Patent Application (Laid-Open) Nos. 110618/1977 and 109925/1977.

With the sensitizing dyes, dyes having no spectral sensitizing effect itself or substances not essentially absorbing a visible light and exhibiting supersensitization may be added simultaneously or separately.

The emulsion of the present invention is preferred to have a hexacyanometal complex doped in the grains.

Among hexacyanometal complexes, those containing iron, ruthenium, osmium, cobalt, rhodium, iridium or chromium are preferred. The amount of the metal complex preferably ranges from $10^{-9}$ to $10^{-2}$ mol, more preferably $10^{-8}$ to $10^{-4}$ mol per mol of silver halide (the total amount of silver at an epitaxial portion and a host portion). The metal complex can be added in the form of a solution in water or an organic solvent. The organic solvent preferably has miscibility with water. Examples of the organic solvent include alcohols, ethers, glycols, ketones, esters and amides. Particularly preferred as the metal complex are hexacyanometal complexes represented by formula (I) described below. Use of an emulsion containing a hexacyanometal complex makes it possible to prepare a high-speed photosensitive material and at the same time, to bring about effects for preventing generation of a fog even after storage of the photosensitive material for a long period of time.

$$[M(CN)_6]^{n-} \quad (I)$$

wherein, M represents iron, ruthenium, osmium, cobalt, rhodium, iridium or chromium and n stands for 3 or 4.

Specific examples of the hexacyanometal complex include:

(I-1) $[Fe(CN)_6]^{4-}$
(I-2) $[Fe(CN)_6]^{3-}$
(I-3) $[Ru(CN)_6]^{4-}$
(I-4) $[Os(CN)_6]^{4-}$
(I-5) $[Co(CN)_6]^{3-}$
(I-6) $[Rh(CN)_6]^{3-}$
(I-7) $[Ir(CN)_6]^{3-}$
(I-8) $[Cr(CN)_6]^{4-}$

As the counter cation of the hexacyanometal complex, use of ions which are readily miscible with water and suitable for the precipitation operation of the silver halide emulsion is preferred. Examples of the counter cation include alkali metal ions (e.g., sodium ion, potassium ion, rubidium ion, cesium ion, lithium ion), an ammonium ion and alkylammonium ions.

The emulsion of the present invention are usually washed with water after grain formation.

Although the temperature upon washing with water can be selected in accordance with using purpose of the emulsion, it is preferably 5° C. to 50° C. Although the pH upon washing with water can also be selected in accordance with the using purpose, it is preferably 2 to 10, more preferably 3 to 8. The pAg upon washing with water is preferably 5 to 10, though it can also be selected in accordance with the using purpose of the emulsion. The washing method can be selected from noodle washing, dialysis against a semipermeable membrane, centrifugal separation, coagulation precipitation, and ion exchange. The coagulation precipitation can be effected using a sulfate, an organic solvent, a water-soluble polymer or a gelatin derivative.

The emulsion of the present invention is preferably subjected to chemical sensitization. As chemical sensitization in the present invention, chalcogen sensitization and noble metal sensitization can be conducted either singly or in combination. This sensitization can be conducted by using an active gelatin as described in T. H. James, The Theory of the Photographic Process, 4th ed., Macmillan, 1977, pp. 67–76; or by using sulfur, selenium, tellurium, gold, platinum, palladium or iridium, or combination of a plurality of these sensitizers at pAg 5 to 10, pH 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In noble metal sensitization, salts of noble metals such as gold, platinum, palladium, and iridium can be used. In particular, gold sensitization, palladium sensitization, and a combination of these two is preferable. For gold sensitization, it is possible to use known compounds such as chloroauric acid, potassium chloroaurate, potassium auric thiocyanate, gold sulfide, and gold selenide. A palladium compound means a divalent or tetravalent salt of palladium. Preferred palladium compounds are each represented by $R_2PdX_6$ or $R_2PdX_4$ wherein R represents a hydrogen atom, an alkali metal atom, or an ammonium group and X represents a halogen atom such as chlorine, bromine or iodine.

Specific preferred examples of the palladium compound include $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. The gold compound or the palladium compound are preferably used in combination with a thiocyanate or selenocyanate.

Examples of the sulfur sensitizer usable in the present invention include hypo, thiourea compounds, rhodanine compounds, and sulfur-containing compounds as described in U.S. Pat. Nos. 3,857,711, 4,266,018 and 4,054,457. Chemical sensitization can also be performed in the presence of a so-called chemical sensitization aid. As the useful chemical sensitization aid, compounds such as azaindene, azapyridazine and azapyrimidine which are known to suppress a fog and increase sensitivity in the process of chemical sensitization are usable. Examples of the chemical sensitization aid or modifier are described in U.S. Pat. Nos. 2,131,038, 3,411,914 and 3,554,757, Japanese Patent Application (Laid-Open) No. 126526/1983, and Duffin, Photographic Emulsion Chemistry, pp. 138–143.

For the emulsion of the present invention, combined use with a gold sensitizer is preferred. The amount of the gold sensitizer is preferably $1\times10^{-4}$ to $1\times10^{-7}$ mol, more preferably, $1\times10^{-5}$ to $5\times10^{-7}$ mol per mol of a silver halide. The palladium compound is preferably added in an amount ranging from $1\times10^{-3}$ to $5\times10^{-7}$ mol per mol of a silver halide. The thiocyan compound or a selenocyan compound is preferably added in an amount ranging from $5\times10^{-2}$ to $1\times10^{-6}$ mol per mol of a silver halide.

The amount of the sulfur sensitizer added to the silver halide grains to be used in the present invention preferably ranges from $1\times10^{-4}$ to $1\times10^{-7}$ mol, more preferably from $1\times10^{-5}$ to $5\times10^{-7}$ mol, per mol of a silver halide.

For the emulsion of the present invention, selenium sensitization is preferred. Known labile selenium compounds are used for selenium sensitization. Specific examples of the selenium compound include colloidal metal selenium, selenoureas (such as N,N-dimethylselenourea and N,N-diethylselenourea), selenoketones and selenoamides. For selenium sensitization, it is sometimes preferable to use, in combination, a sulfur sensitizer or a noble metal sensitizer, or both of these sensitizers.

For tellurium sensitization, labile tellurium compounds are used. Examples of the labile tellurium compound usable here include compounds as described in Japanese Patent Application (Laid-Open) No. 224595/1992, 271341/1992, 333043/1992, 303157/1993, 27573/1994, 175258/1994, 180478/1994, 208184/1994, 208186/1994, 317867/1994, 140579/1995, 301879/1995 and 301880/1995.

Specific examples include phosphine tellurides (e.g., normal-butyl-diisopropylphosphine telluride, triisobutylphosphine telluride, tri-normal-butoxyphosphine telluride and triisopropylphosphine telluride), diacyl (di)ditellurides (e.g., bis(diphenylcarbamoyl)ditelluride, bis(N-phenyl-N-methylcarbamoyl) ditelluride, bis(N-phenyl-N-methylcarbamoyl) telluride, bis(N-phenyl-N-benzylcarbamoyl) telluride and bis(ethoxycarbonyl) telluride), telluroureas (e.g., N,N'-dimethylethylene tellulourea), telluroamides, and telluloesters. Of these, preferred are phosphine tellurides and diacyl (di)tellurides.

Photographic emulsions used in the present invention may contain various compounds in order to prevent fogging during preparation, storage, or photographic treatment of a photosensitive material, or to stabilize photographic performances. For such purposes, many compounds known as an anti-fogging agent or stabilizer can be added. Examples thereof include thiazoles such as benzothiazolium salts, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; thioketo compounds such as oxadolinethione; azaindenes, such as triazaindenes, tetrazaindenes (particularly 4-hydroxy-substituted substituted(1,3,3a,7) tetrazaindenes), and pentazaindenes. For example, compounds as described in U.S. Pat. Nos. 3,954,474 and 3,982,947 and Japanese Patent Publication No. 28660/1977 can be used. One of the preferable compounds is that as described in Japanese Patent Application (Laid-Open) No. 212932/1988. The anti-fogging agent or stabilizer can be added at any stage in consideration of the using purpose of the emulsion, for example, before grain formation, during grain formation, after grain formation, upon washing with water, upon dispersion after washing with water, upon epitaxial formation, before chemical sensitization, during chemical sensitization, after chemical sensitization or before coating. The anti-fogging agent or stabilizer can be used for various purposes, in addition to its original purpose to prevent fogging and stabilize the performances, for example, to control crystal habit of grains, decrease the grain size, reduce the solubility of the grains, control chemical sensitization, and control arrangement of dyes.

Upon preparation of the emulsion of the present invention, it is preferred, though depending on the purpose, to make a metal ion salt exist, for example, during grain formation, desalting, or chemical sensitization, or before coating. The metal ion salt is preferably added upon grain formation in the case where the salt is doped into grains, and after grain formation but before completion of chemical sensitization in the case where the salt is used as a grain surface modifier or as a chemical sensitizer. The doping method can be selected from doping into the whole grain, doping into only the core of the grain or the doping into only the shell of the grain. Examples of the metal usable for doping include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. Any of these metals in the form of a soluble salt upon grain formation, such as ammonium salt, acetate, nitrate, sulfate, phosphate, hydroacid salt, 6-coordinated complex salt, or 4-coordinated complex salt can be added. Examples of the salt include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in combination of two or more of them.

The metal compounds are preferably used after dissolved in water or an appropriate organic solvent such as methanol or acetone. It is possible to add an aqueous hydrogen halide solution (e.g., HCl or HBr) or an alkali halide (e.g., KCl, NaCl, KBr or NaBr) in order to stabilize the solution. It is also possible to add an acid or alkali as needed. The metal compound can be added to a reaction vessel either before or during grain formation. It is also possible to add the metal compound to an aqueous solution of a water soluble silver salt (e.g., $AgNO_3$) or an aqueous alkali halide solution (e.g., NaCl, KBr or KI) in advance and then continuously add the resulting mixture during formation of silver halide grains. Furthermore, a solution of the metal compound which has been prepared separately from a solution of a water soluble silver salt or a solution of an alkali halide may be added continuously at a proper time during grain formation. It is also preferred to use these various adding methods in combination.

It is preferred to subject the silver halide photographic emulsion of the present invention to reduction sensitization during or after grain formation, or before, during or after chemical sensitization.

The reduction sensitization can be effected by any one selected from a method of adding a reduction sensitizer to the silver halide emulsion, a method called silver ripening in which grains are grown or ripened in a low-pAg atmosphere at pAg 1 to 7, and a method called high-pH ripening in which grains are grown or ripened in a high-pH atmosphere at pH 8 to 11. It is also possible to use at least two of these methods in combination.

Addition of a reduction sensitizer is preferred, because it permits delicate adjustment of the level of reduction sensitization.

Examples of known reduction sensitizers include stannous salts, ascorbic acid and derivatives thereof, amines, polyamines, hydrazine derivatives, formamidinesulfinic acid, silane compounds, and borane compounds. For the reduction sensitization of the present invention, a proper one selected from these known reduction sensitizers is usable and they can be used either singly or in combination. Preferred examples of the reduction sensitizer include stannous chloride, thiourea dioxide, dimethylamineborane, and ascorbic acid and derivatives thereof. Although the amount of the reduction sensitizer must be selected, depending on the emulsion preparing conditions, a proper amount ranges from $10^{-7}$ to $10^{-3}$ mol per Mol of a silver halide.

During growth of grains, the reduction sensitizer is dissolved in, for example, water or an organic solvent such as an alcohol, glycol, ketone, ester or amide and then, the solution is added. It can be added to the reaction vessel in advance, but addition at a proper time during growth of grains is preferred. It is also possible to add the reduction sensitizer to an aqueous solution of a water soluble silver salt or a water soluble alkali halide in advance and precipitate silver halide grains by using this aqueous solution. Alternatively, with grain growth, addition of a solution of the reduction sensitizer in portions or addition of the solution continuously for long hours is also preferred.

During preparation of the emulsion of the present invention, use of an oxidizing agent of silver is preferred. The oxidizing agent of silver means a compound having an effect of converting metal silver into silver ions. Compounds capable of converting very fine silver grains, which are by-produced during formation or chemical sensitization of silver halide grains, into silver ions are particularly effective. The silver ions thus prepared may form a silver salt sparingly soluble in water, such as a silver halide, silver sulfide or silver selenide, or a silver salt easily soluble in water, such as silver nitrate. The oxidizing agent of silver may be either an inorganic or organic substance. Examples of the inorganic oxidizing agent include ozone, hydrogen peroxide and adducts thereof (e.g., $NaBO_2 \cdot H_2O_2 \cdot 3H_2O$, $2NaCO_3 \cdot 3H_2O_2$, $Na_4P_2O_7 \cdot 2H_2O_2$ and $2Na_2SO_4 \cdot H_2O_2 \cdot 2H_2O$), peroxy acid salts (e.g., $K_2S_2O_8$, $K_2C_2O_6$, and $K_2P_2O_8$), peroxy complex compounds (e.g., $K_2[Ti(O_2)C_2O_4] \cdot 3H_2O$, $4K_2SO_4 \cdot Ti(O_2)OH \cdot SO_4 \cdot 2H_2O$ and $Na_3[VO(O_2)(C_2H_4)_2] \cdot 6H_2O$), oxyacid salts such as permanganates (e.g., $KMnO_4$) and chromates (e.g., $K_2Cr_2O_7$), a halogen element such as iodine and bromine, IMF perhalogenates (e.g., potassium periodate), salts of a high valence metal (e.g., potassium hexacyanoferrate (II)) and thiosulfonates.

Examples of the organic oxidizing agent include quinones such as p-quinone, organic peroxides such as peracetic acid and perbenzoic acid, and compounds releasing an active halogen (e.g., N-bromosuccinimide, chloramine T, and chloramine B).

As the oxidizing agent of the present invention, preferred are inorganic oxidizing agents such as ozone, hydrogen peroxide and adducts thereof, halogen elements and thiosulfonates, and organic oxidizing agents such as quinones. Use of the above-described reduction sensitization in combination with the oxidizing agent of silver is preferred. A method of using them in combination can be selected from reduction sensitization after use of the oxidizing agent, vice versa and simultaneous use of them. Also in the grain formation or chemical sensitization step, a method permitting combined use can be selected from them.

A photosensitive material prepared using the silver halide emulsion available by the present invention must have at least one photosensitive layer. Preferably, it is only necessary that the photosensitive material has, on the support thereof, at least one silver halide emulsion layer of each of a blue-sensitive layer, a green-sensitive layer and a red-sensitive layer and at least one of these blue-sensitive, green-sensitive and red-sensitive layers may be formed of at least two layers different in sensitivity. No particular limitation is imposed on the number or order of these silver halide emulsion layers and non-photosensitive layers. A typical example is a silver halide photosensitive material having, on the support thereof, at least one color-sensitive layer constituted by a plurality of silver halide emulsion layers which are substantially sensitive to the same color but have different sensitivities. This photosensitive layer is a unit sensitive layer which is sensitive to any one of a blue light, green light, and red light. In a multilayered silver halide color photosensitive material, such unit photosensitive layers are generally arranged in the order of red-, green-, and blue-sensitive layers from a support side. However, according to the purpose, this arrangement order can be reversed, or layers sensitive to the same color can sandwich another layer sensitive to a different color.

A light-insensitive layer such as interlayer can be formed between the silver halide sensitive layers, as the uppermost layer or as the lowermost layer.

The interlayer can contain a coupler or a DIR compound as described in Japanese Patent Application (Laid-Open) No. 43748/1986, 113438/1984, 113440/1984, 20037/1986 and 20038/1986, or can contain a color mixture inhibitor as commonly used.

As described in West German Patent No. 1,121,470 or British Patent No. 923,045, a plurality of silver halide emulsion layers constituting each unit photosensitive layer is preferably formed of two layers, that is, a high-speed emulsion layer and a low-speed emulsion layer. In general, these layers are preferably arranged such that the sensitivity gradually decreases toward the support. The light-insensitive layer may be disposed between the silver halide emulsion layers. As described in Japanese Patent Application (Laid-Open) No. 112751/1982, 200350/1987, 206541/1987, or 206543/1987, the low-speed emulsion layer may be disposed on the side remote from the support whereas the high-speed emulsion layer may be disposed on the side close to the support.

Specific examples of the disposal from the farthest side from a support include disposal in the order of a low-speed blue-sensitive layer (BL)/a high-speed blue-sensitive layer (BH)/a high-speed green-sensitive layer (GH)/a low-speed green-sensitive layer (GL)/a high-speed red-sensitive layer (RH)/a low-speed red-sensitive layer (RL); disposal in the order of BH/BL/GL/GH/RH/RL; and disposal in the order of BH/BL/GH/GL/RL/RH.

Alternatively, as described in Japanese Patent Publication No. 34932/1980, layers can be disposed from the farthest side from a support in the order of a blue-sensitive layer/GH/RH/GL/RL.

Also, as described in Japanese Patent Application (Laid-Open) No. 25738/1981 or 63936/1987, layers can be disposed from the farthest side from a support in the order of a blue-sensitive layer/GL/RL/GH/RH.

Another example is, as described in Japanese Patent Publication No. 15495/1974, disposal of three layers different in sensitivity and having a lower sensitivity toward the support, more specifically, disposal, as an upper layer, of a silver halide emulsion layer having the highest sensitivity, a silver halide emulsion layer, as an interlayer, having a sensitivity lower than that of the upper layer, and a silver halide emulsion layer, as a lower layer, having a sensitivity lower than that of the interlayer. Even if a photosensitive material is constituted by such three layers having different sensitivities, these layers can be disposed, from the farthest side from a support, in the order of a medium-speed emulsion layer/a high-speed emulsion layer/a low-speed emulsion layer in a layer sensitive to one color, as described in Japanese Patent Application (Laid-Open) No. 202464/1984.

Layers may be disposed also in the order of a high-speed emulsion layer/a low-speed emulsion layer/a medium-speed emulsion layer or a low-speed emulsion layer/a medium-speed emulsion layer/a high-speed emulsion layer.

Even when the photosensitive material has four or more layers, the arrangement thereof may be changed as described above.

As the emulsion of the present invention, tabular grain emulsions containing a dislocation line on the fringe portion as described in Japanese Patent Application (Laid-Open) No. 174606/1999 or 295832/1999 are preferred. The silver amount (mass in the term of a silver atom unit) of the emulsion used for each emulsion layer is preferably 0.3 to 3 $g/m^2$, more preferably 0.5 to 2 $g/m^2$.

As described above, layer constitutions and disposal can be selected, depending on the purpose of the photosensitive material.

In addition to the various additives as described above, a variety of the other additives are also usable for the photosensitive material of the present invention, depending on the purpose.

These additives are described in further detail in Research Disclosures Item 17643 (December, 1978), Item 18716 (November, 1979), and Item 308119 (December, 1989), and the corresponding parts are summarized in the below-described table.

| Additive | RD17643 | RD18716 | RD308119 |
|---|---|---|---|
| 1. Chemical sensitizer | Page 23 | Right column on page 648 | Page 996 |
| 2. Sensitivity-increasing agent | | Right column on page 648 | |
| 3. Spectral sensitizer, Super sensitizer | Pages 23 to 24 | Right column on page 648 to right column on page 649 | Right column on page 996 to right column on page 998 |
| 4. Brightening agent | Page 24 | Right column on page 647 | Right column on page 998 |
| 5. Anti-fogging agent and Stabilizer | pages 24 to 25 | Right column on page 649 | Right column on page 998 to right column on page 1000 |
| 6. Light absorbent, Filter dye, Ultraviolet absorbent | pages 25 to 26 | Right column on page 649 to left column on page 650 | Left to right column on page 1003 |
| 7. Stain-preventing agent | Right column on page 25 | Left column to right column on page 650 | Right column on page 1002 |
| 8. Dye image stabilizer | Page 25 | | Right column on page 1002 |
| 9. Film hardener | Page 26 | Left column on page 651 | Right column on page 1004 to left column on page 1005 |
| 10. Binder | Page 26 | Left column on page 651 | Right column on page 1003 to right column on page 1004 |
| 11. Plasticizer, Lubricant | Page 27 | Right column on page 650 | Left column on page 1006 to right column on page 1006 |
| 12. Coating aid, Surfactant | Pages 26 to 27 | Right column on page 650 | Left column on page 1005 to left column on page 1006 |
| 13. Antistatic agent | Page 27 | Right column on page 650 | Right column on 1006 to left column on page 1007 |
| 14. Matting agent | | | Left column on page 1008 to left column on page 1009 |

In order to prevent deterioration in photographic performance due to a formaldehyde gas, it is preferred to add, to a photosensitive material, a compound which is described in U.S. Pat. No. 4,411,987 or 4,435,503 and is capable of reacting with formaldehyde, thereby fixing it.

Various color couplers are usable in the present invention. Specific examples of these couplers are described in the patents mentioned in the above-described Research Disclosure No. 17643, VII-C to VII-G and No. 307105, VII-C to VII-G.

As a yellow coupler, preferred are those described, for example, in U.S. Pat. Nos. 3,933,501, 4,022,620, 4,326,024, 4,401,752, and 4,248,961, Japanese Patent Publication No. 10739/1983, British Patent Nos. 1,425,020 and 1,476,760, U.S. Pat. Nos. 3,973,968, 4,314,023 and 4,511,649, and European Patent No. 249,473A.

As a magenta coupler, preferred are 5-pyrazolone and pyrazoloazole compounds. Especially preferred are compounds described, for example, in U.S. Pat. Nos. 4,310,619 and 4,351,897, European Patent No. 73,636, U.S. Pat. Nos. 3,061,432 and 3,725,067, Research Disclosure No. 24220 (June 1984), Japanese Patent Application (Laid-Open) No.

33552/1985, Research Disclosure No. 24230 (June 1984), Japanese Patent Application (Laid-Open) Nos. 43659/1985, 72238/1986, 35730/1985, 118034/1980 and 185951/1985, U.S. Pat. Nos. 4,500,630, 4,540,654, and 4,556,630, and WO88/04795.

As a cyan coupler, phenol and naphthol couplers are usable. Preferred examples include those described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and Japanese Patent Application (Laid-Open) No. 42658/1986.

Typical examples of a polymerized dye-forming coupler include those described in U.S. Pat. Nos. 3,451,820, 4,080,211, 4,367,282, 4,409,320 and 4,576,910, British Patent No. 2,102,137, and European Patent No. 341,188A.

Preferred examples of a coupler whose dye exhibits sufficient diffusion include those described in U.S. Pat. No. 4,366,237, British Patent No. 2,125,570, European Patent No. 96,570 and West German Patent (OT-OS) No. 3,234,533.

Preferred examples of a colored coupler for correcting undesired absorption of a dye include those described in Research Disclosure Nos. 17643 VII-G and 307105 VII-G, U.S. Pat. No. 4,163,670, Japanese Patent Publication No. 39413/1982, U.S. Pat. Nos. 4,004,929 and 4,138,258, British Patent No. 1,146,368. A coupler, as described in U.S. Pat. No. 4,774,181, for correcting undesired absorption of a dye by making use of a fluorescent dye released upon coupling or a coupler, as described in U.S. Pat. No. 4,777,120, having a dye precursor group which can react with a developing agent to form a dye as a releasing group is preferably employed.

Compounds releasing a photographically useful residue upon coupling are also preferred in the present invention. Preferred examples of DIR couplers which release a development inhibitor include those described in the patents cited in the above-described RD No. 17643, VII-F, RD No. 307105, VII-F, Japanese Patent Application (Laid-Open) Nos. 151944/1982, 154234/1982, 184248/1985, 37346/1988 and 37350/1988, and U.S. Pat. Nos. 4,248,962 and 4,782,012.

Preferred examples of a coupler for imagewisely releasing a nucleating agent or a development accelerator upon development include those described in British Patent Nos. 2,097,140 and 2,131,188, and Japanese Patent Application (Laid-Open) Nos. 157638/1984 and 170840/1984. Compounds, as described in Japanese Patent Application (Laid-Open) Nos. 107029/1985, 252340/1985, 44940/1989 and 45687/1989, which release a fogging agent, a development accelerator or a silver halide solvent upon a redox reaction with the oxidized product of a developing agent are also preferred.

Examples of the other couplers usable for the photosensitive material of the present invention include competitive couplers as described in U.S. Pat. No. 4,130,427, poly-equivalent couplers as described in U.S. Pat. No. 4,283,472, 4,338,393, and 4,310,618, couplers which release a DIR redox compound, couplers which release a DIR coupler, redox compounds which release a DIR coupler, or redox compounds which release a DIR redox as described in Japanese Patent Application (Laid-Open) No. 185950/1985 and 24252/1987, couplers which release a dye capable of restoring a color after release as described in European Patent Nos. 173,302A and 313,308A, couplers which release a bleach accelerating agent as described in RD Nos. 11449 and 24241 and Japanese Patent Application (Laid-Open) No. 201247/1986, couplers which release a ligand as described in U.S. Pat. No. 4,555,477, couplers which release a leuco dye as described in Japanese Patent Application (Laid-Open) No. 75747/1988, and couplers which release a fluorescent dye as described in U.S. Pat. No. 4,774,181.

Couplers to be used in the present invention can be introduced into a photosensitive material by various known dispersion methods.

Examples of a high-boiling point solvent to be used in an oil-in-water dispersion method are described, for example, in U.S. Pat. No. 2,322,027.

Specific examples of the high-boiling point organic solvent having a boiling point of 175° C. or greater at atmospheric pressure for use in the oil-in-water dispersion process include phthalic acid esters (such as dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate and bis(1,1-diethylpropyl) phthalate); phosphoric acid or phosphonic acid esters (such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate); benzoic acid esters (such as 2-ethylhexyl benzoate, dodecyl benzoate and 2-ethylhexyl-p-hydroxy benzoate); amides (such as N,N-diethyldodecaneamide, N,N-diethyllaurylamide and N-tetradecylpyrrolidone); alcohols or phenols (such as isostearyl alcohol and 2,4-di-tert-amyl phenol); aliphatic carboxylic acid esters (such as bis(2-ethylhexyl) sebacate, dioctyl azelate, glycerol tributylate, isostearyl lactate and trioctyl citrate); aniline derivatives (such as N,N-dibutyl-2-butoxy-5-tert-octylaniline); and hydrocarbons (such as paraffin, dodecylbenzene, and diisopropylnaphthalene).

An organic solvent having a boiling point of about 30° C. or greater, preferably 50° C. or greater but not greater than about 160° C., can be used as a co-solvent. Typical examples include ethyl acetate, butyl acetate, ethyl propionate, methyl ethyl ketone, cyclohexanone, 2-ethoxyethyl acetate and dimethylformamide.

The steps and effects of a latex dispersion method and examples of an impregnating latex are described, for example, in U.S. Pat. No. 4,199,363 and West German Patent Application (OLS) Nos. 2,541,274 and 2,541,230.

To the color photosensitive material of the present invention, various antiseptics or antifungal agents are preferably added. Examples include phenethyl alcohol, and 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole as described in Japanese Patent Application (Laid-Open) Nos. 257747/1988, 272248/1987 and 80941/1989.

The present invention can be applied to various photosensitive materials, preferably various black and white or color photosensitive materials. Typical examples include color negative films for a general purpose or a movie, color reversal films for a slide or television, color paper, color positive films, and color reversal paper. Application of the present invention to a color dupe film is especially preferred.

A support suited for used in the present invention is described, for example, in the RD. No. 17643, page 28, No. 18716, from page 647, right column to page 648, left column, and No. 307105, page 879.

In the photosensitive material of the present invention, the total film thickness of all the hydrophilic colloid layers on the side having emulsion layers is preferably 28 μm or less, more preferably 23 μm or less, still more preferably 18 μm or less, and especially preferably 16 μm or less. The film swelling rate $T_{1/2}$ is preferably 30 sec or less, more preferably 20 sec or less. The term "film thickness" as used herein means film thickness as measured for two days at 25° C. while adjusting a relative humidity to 55%, and the film swelling rate $T_{1/2}$ can be measured in a manner known per se in the art. For example, the film swelling rate $T_{1/2}$ can be measured using a swellometer (swell-measuring meter) of the type described by A. Green et al. in Photographic Science and Engineering, 19(2), 124–129. The $T_{1/2}$ is defined as the time required to reach a film thickness of ½ of the saturated film thickness, supposing that 90% of the maximum swelled film thickness attained by the treatment of the film with a color developer at 30° C. for 3 min 15 sec is the saturated film thickness.

The film swelling speed $T_{1/2}$ can be adjusted by adding a film hardener to gelatin as a binder or by changing conditions after coating under which the photosensitive material is kept.

The photosensitive material of the present invention preferably has, on the side opposite to the side having emulsion layers, hydrophilic colloid layers (which will hereinafter be called "back layers") having a total dry film thickness of 2 to 20 μm. The back layers preferably contain, for example, the light absorbent, filter dye, ultraviolet absorbent, antistatic agent, film hardener, binder, plasticizer, lubricant, coating aid, and surfactant as described above. The swelling ratio of these back layers is preferably 150% to 500%.

A color photosensitive material according to the present invention can be developed in a conventional manner as described in the RD. No. 17643, pp. 28–29, No. 18716, p. 615, the left to right column, and No. 307105, pp. 880–881.

A color developer used in the development of a photosensitive material of the present invention is preferably an aqueous alkaline solution mainly composed of an aromatic primary amine-based color developing agent. As this color developing agent, aminophenol compounds are effective, but p-phenylenediamine compounds are preferably used. Typical examples of them include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, and p-toluenesulfonates thereof. Of these compounds, 3-methyl-4-amino-N-ethyl-N-β-hydroxyethylaniline sulfate is especially preferred. Two or more of these compounds may be used in combination, depending on the purpose.

The color developer usually contains a pH buffer such as a carbonate, borate or phosphate of an alkali metal, and a development inhibitor or an anti-fogging agent such as a chloride, a bromide, an iodide, a benzimidazole, a benzothiazole or a mercapto compound. If necessary, the color developer can also contain a preservative such as hydroxylamine, diethylhydroxylamine, a sulfite, a hydrazine such as N,N-biscarboxymethylhydrazine, a phenylsemicarbazide, triethanolamine or a catechol sulfonic acid; an organic solvent such as ethylene glycol or diethylene glycol; a development accelerator such as benzyl alcohol, polyethylene glycol, a quaternary ammonium salt or an amine; a dye forming coupler, a competitive coupler or an auxiliary developing agent such as 1-phenyl-3-pyrazolidone; a tackifier; and a chelating agent represented by aminopolycarboxylic acid, aminopolyphosphonic acid, alkylphosphonic acid or phosphonocarboxylic acid. Representative examples of the chelating agent include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts of these acids.

For reversal development, black-and-white development is usually carried out, followed by color development. As the black-and-white developer, known black-and-white developing agents, for example, dihydoxybenzenes such as hydroquinone, 3-pyrazolidones such as 1-phenyl-3-pyrazolidone and aminophenols such as N-methyl-p-aminophenol can be used either singly or in combination. These color developers and black-and-white developers usually have a pH of 9 to 12. The replenishment amount of these developers is usually 3 liters (liter may hereinafter be referred to as "L") or less per $m^2$ of a color photosensitive material to be processed, though depending on the nature of the material. This replenishment amount can be decreased to 500 milliliters (milliliter may hereinafter be referred to as "mL") or less by decreasing a bromide ion concentration in the replenisher in advance. When the replenishment amount is reduced, it is preferred to decrease the contact area of a processing solution with air, thereby preventing evaporation and air oxidation of the solution.

The contact area of the photographic processing solution with air in a processing tank can be represented by an opening ratio defined below:

$$\text{Opening ratio}=[\text{contact area } (cm^2) \text{ of processing solution to air}]\div[\text{volume } (cm^3) \text{ of processing solution}]$$

The opening ratio is preferably 0.1 or less, more preferably 0.001 to 0.05. Examples of a method to reduce the opening ratio include, as well as a method of disposing a shield such as floating cover on the surface of the photographic processing solution in the processing tank, a method of using a movable cover as described in Japanese Patent Application (Laid-Open) No. 82033/1989, and a slit developing method as described in Japanese Patent Application (Laid-Open) No. 216050/1988. A reduction in the opening ratio is preferably applied not only to both color development and black-and-white development steps but also to all subsequent steps such as bleaching, bleach-fixing, fixing, washing with water, and stabilizing. The replenishment amount can also be reduced by suppressing accumulation of bromide ions in the developer.

The color development time is usually set between two to five minutes. This time, however, can be shortened by carrying out development at higher temperature and pH and using the color developing agent at a higher concentration.

A photographic emulsion layer is usually bleached after color development. Bleaching may be conducted either simultaneously with fixing treatment (bleach-fixing treatment) or independently. Bleach-fixing treatment may be carried out after bleaching in order to increase the treatment speed. It is also possible to carry out bleach-fixing in a bleach-fixing bath having two continuous tanks, carry out fixing prior to bleach-fixing, or carry out bleaching after bleach-fixing as desired in accordance with the purpose. Examples of the bleaching agent include compounds of a multivalent metal such as iron(III), peracids (in particular, sodium persulfate is suited to color negative cine films), quinones, and niitro compounds. Typical examples of the bleaching agent include organic complex salts of iron(III), e.g., complex salts with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid and glycoletherdiaminetetraacetic acid, and complex salts of citric acid, tartaric acid, and malic acid. Of these, iron(III) complex salts of an aminopolycarboxylic acid such as iron(III) complex salts of ethylenediaminetetraacetic acid and 1,3-diaminopropanetetraacetic acid are preferred for rapid treatment and prevention of environmental pollution. The iron(III) complex salts of an aminopolycarboxylic acid are particularly useful in both the bleaching solution and bleach-fixing solution. The bleaching or bleach-fixing solution containing the iron(III) complex salt of an aminopolycarboxylic acid usually has a pH of 4.0 to 8. Their treatments can be effected at a lower pH in order to increase the processing speed.

In the bleaching solution, bleach-fixing solution, or their pre-bath, a bleach accelerator can be incorporated as needed. Examples of the useful bleach accelerator include compounds having a mercapto or disulfide group as described in U.S. Pat. No. 3,893,858, West German Patent Nos. 1,290,812 and 2,059,988, Japanese Patent Application (Laid-Open) Nos. 32736/1978, 57831/1978, 37418/1978, 72623/1978, 95630/1978, 95631/1978, 104232/1978, 124424/1978, 141623/1978 and 18426/1978, and Research Disclosure No. 17129 (July, 1978); thiazolidine derivatives as described in Japanese Patent Application (Laid-Open) No. 140129/1976; thiourea derivatives as described in Japanese Patent Publication No. 8506/1970, Japanese Patent Application (Laid-Open) Nos. 20832/1977 and 32735/1978, and U.S. Pat. No. 3,706,561; iodide salts as described in West German Patent No. 1,127,715 and Japanese Patent Application (Laid-Open) No. 16235/1983; polyoxyethylene compounds as described in West German Patent Nos. 966,410 and 2,748,430; polyamine compounds as described in Japanese Patent Publication No. 8836/1970; compounds as described in Japanese Patent Application (Laid-Open) Nos. 40943/1974, 59644/1974, 94927/1978, 35727/1979, 26506/1980 and 163940/1983; and bromide ion. Of these, compounds having a mercapto or disulfide group are preferred for large bleach acceleration effects, with compounds as described in U.S. Pat. No. 3,893,858, West German Patent No. 1,290,812, and Japanese Patent Application (Laid-Open) No. 95630/1978 being particularly preferred. Compounds described in U.S. Pat. No. 4,552,884 are also preferred. These bleach accelerators may be added to a photosensitive material. They are especially effective for bleach-fixing of a color photosensitive material for photography.

Incorporation of an organic acid, in addition to the above compounds, in the bleaching solution or the bleach-fixing solution is preferred in order to prevent bleaching stains. Compounds having an acid dissociation constant (pKa) of 2 to 5 such as acetic acid, propionic acid and hydroxyacetic acid are especially preferred.

Examples of the fixer to be incorporated in the fixing solution or bleach-fixing solution include thiosulfates, thiocyanates, thioether compounds, thioureas, and a large amount of iodide salts. Of these, thiosulfates are ordinarily employed, with ammonium thiosulfate being usable most widely. Use of this thiosulfate in combination with a thiocyanate, a thioether compound or thiourea is also preferred. Preferred examples of a preservative of the fixing solution or the bleach-fixing solution include sulfites, bisulfites, carbonyl bisulfite adducts and sulfinic acid compounds as described in European Patent No. 294,769A. Furthermore, addition of an aminopolycarboxylic acid or organic phosphonic acid to the fixing solution or bleach-fixing solution is preferred for the purpose of stabilizing the solution.

In the present invention, it is preferred to add, to the fixing solution or bleach-fixing solution, 0.1 to 10 mol/L of a compound having a pKa of 6.0 to 9.0, more preferably, an imidazole such as imidazole, 1-methylimidazole, 1-ethylimidazole or 2-methylimidazole in order to adjust the pH of the solution.

The total desilvering time as short as possible within an extent not causing a desilvering defect is preferred. The desilvering time preferably ranges from 1 to 3 minutes, more preferably, 1 to 2 minutes. The desilvering temperature ranges from 25° C. to 50° C., preferably 35° C. to 45° C. Within the above-described preferable temperature range, the desilvering speed increases, and generation of stains after desilvering can be effectively prevented.

In the desilvering step, stirring as vigorous as possible is preferred. Specific examples of an stirring enhancing method include a method of colliding a jet stream of the processing solution against the emulsion surface of a photosensitive material as described in Japanese Patent Application (Laid-Open) No. 183460/1987, and a method of increasing the stirring effect by using a rotating means as described in Japanese Patent Application (Laid-Open) No. 183461/1987. Other examples include a method of improving the stirring effect by moving a photosensitive material while bringing a wiper blade disposed in the solution in contact with the emulsion surface, thereby causing turbulence on the emulsion surface, and a method of increasing the circulating flow rate of the whole processing solution. Such a stirring improving means is effective in any one of the bleaching solution, the bleach-fixing solution, and the fixing solution. Improvement in stirring is presumed to increase the feeding speed of the bleaching agent to the emulsion film and that of the fixer, thereby raising the desilvering rate. The stirring improving means is more effective when a bleach accelerator is used. This combined use markedly improves the accelerating effect or the bleaching accelerator serves to eliminate inhibitory action against fixing.

An automatic film processor to be used for the development of the photosensitive material of the present invention is preferred to have a means for carrying photosensitive materials, as described in Japanese Patent Application (Laid-Open) No. 191257/1985, 191258/1985, or 191259/1985. As described in the Japanese Patent Application (Laid-Open) No. 191257/1985, this carrying means can significantly reduce the transferred amount of the processing solution from a pre-bath to a post-bath, thereby effectively preventing a deterioration in the performance of the processing solution. This effect leads to shortening of the processing time in each step and reducing the replenishment amount of the processing solution.

The silver halide photosensitive material of the present invention is usually washed with water and/or stabilized after desilvering. The amount of water used upon washing can be determined within a wide range, depending on the properties (e.g., a property determined by a raw material used such as a coupler) of the photosensitive material, applications, the temperature of the water for washing, the number of water-washing tanks (the number of stages), a replenishing method such as a counter or forward current, and other various conditions. The relationship between the amount of water and the number of water-washing tanks in a multi-stage counter-current method can be determined by the method described in "Journal of the Society of Motion Picture and Television Engineering", 64, 248–253 (May, 1955).

According to the above-described multi-stage counter-current method, the amount of water used for washing can be markedly decreased. It is however accompanied with the problem that bacteria proliferate by an increase in the retention time of water in the tank and suspended matters adhered to the photosensitive material. As a countermeasure against such a problem, a method of reducing the amount of calcium ions and magnesium ions as described in Japanese Patent Application (Laid-Open) 288838/1987 exhibits marked effects in the processing of the color photosensitive material of the present invention. It is also possible to use bactericide, for example, an isothiazolone compound, a cyabendazole or a chlorine-based bactericide such as chlorinated sodium isocyanurate as described in Japanese Patent Application (Laid-Open) No. 8542/1982, and moreover, a bactericide such as benzotriazole as described in Hiroshi Horiguchi, "Chemistry of Antibacterial and Antifungal Agents", (1986), published by Sankyo Publishing Co., Eiseigijutsu-Kai ed., "Sterilization, Antibacterial, and Antifungal Techniques for Microorganisms", (1982), published by Kogyogijutsu-Kai, and The Society for Antibacterial and Antifungal Agents, Japan, ed., "Dictionary of Antibacterial and Antifungal Agents", (1986).

The pH of water to be used for washing the photosensitive material of the present invention is 4 to 9, preferably 5 to 8. Although the water temperature and the washing time can be determined, depending on the properties or application of the photosensitive material, the washing time is usually selected from a range of 20 sec to 10 min at a temperature of 15° C. to 45° C., preferably 30 sec to 5 min at 25° C. to 40° C. The photosensitive material of the present invention can be processed directly with a stabilizing solution instead of washing with water. Any one of the known methods described in Japanese Patent Application (Laid-Open) No. 8543/1982, 14834/1983 and 220345/1985 is usable in such stabilizing treatment.

The washing treatment with water may be followed by stabilizing treatment. A stabilizing bath containing a dye stabilizer and a surfactant serves as a final bath of a color photosensitive material for photography. Examples of the dye stabilizing agent include aldehydes such as formalin and glutaraldehyde, N-methylol compounds, hexamethylenetetramine, and aldehyde sulfurous acid adducts. Various chelating agents or antifungal agents can be added to the stabilizing bath.

An overflow solution produced upon washing and/or replenishment of the stabilizing solution can be reused in another step such as the desilvering step.

In processing using an automatic film processor, for example, if each processing solution described above is concentrated by evaporation, water is preferably added to correct the concentration.

In the silver halide color photosensitive material of the present invention, a color developing agent may be incorporated for simplification of treatment and rapid treatment. For incorporation, various precursors of the color developing agent are preferably used. Examples of the precursor include indoaniline compounds as described in U.S. Pat. No. 3,342,597, Schiff base compounds as described in U.S. Pat. No. 3,342,599 and Research Disclosure Nos. 14,850 and 15,159, aldol compounds described in RD No. 13,924, metal salt complexes described in U.S. Pat. No. 3,719,492, and urethane compounds described in Japanese Patent Application (Laid-Open) No. 135628/1978.

The silver halide color photosensitive material of the present invention can contain a 1-phenyl-3-pyrazolidone in order to accelerate color development as needed. Typical compounds are described in Japanese Patent Application (Laid-Open) No. 64339/1981, 144547/1982, and 115438/1983.

Each processing solution in the present invention is used at 10° C. to 50° C. Although the processing temperature is usually 33° C. to 38° C., processing can be accelerated to shorten the processing time at increased temperatures, or the image quality or the stability of a processing solution can be improved at lowered temperatures.

The silver halide photosensitive material of the present invention can be applied to photothermographic materials as described, for example, in U.S. Patent No. 4,500,626, Japanese Patent Application (Laid-Open) No. 133449/1985, 218443/1984 or 238056/1986, or European Patent No. 210,660A2.

When the silver halide color photosensitive material of the present invention is applied to a film unit equipped with a lens, as described in Japanese Patent Publication No. 32615/1990 or Japanese Utility Model Publication No. 39784/1991, its effects can be exhibited more readily.

EXAMPLE

The present invention will hereinafter be described by Examples.

Example 1

Preparation of Tabular Silver Bromoiodide Grains

In this Example, tabular grains were prepared as described below by using a mixer (having an internal volume of 0.5 ml) disclosed in FIG. 1 of Japanese Patent Application (Laid-Open) No. 239787/1998 in the system disclosed in FIG. 2 of the same literature and by using, instead of the mixer, a microreactor as described herein, respectively.

Emulsion 1-A (Comparison)

To the mixer shown in the FIG. 1 (having an internal volume of 0.5 ml) containing nothing were successively added 500 ml of a 0.021M aqueous solution of silver nitrate and 500 ml of a 0.028M aqueous KBr solution containing 0.1 wt. % (i.e., mass %) of low molecular weight gelatin (average molecular weight of 40,000) and the resulting emulsion was continuously charged in a reaction vessel over 20 minutes, whereby 1000 ml of a fine grain emulsion was obtained. Upon this mixing, the stirrer of the mixer was rotated at a frequency of 2000 rpm (nucleus formation).

After 300 ml of a 10% ossein gelatin solution having a 95% phthalated amino group and KBr were added to convert pBr of the emulsion in the reaction vessel to 2.1, the temperature was increased to 75° C., at the temperature, the mixture was allowed to stand for 5 minutes (ripening).

To the mixer, 600 ml of a 1.0M aqueous silver nitrate solution, 600 ml of 0.99M KBr containing 3 mol % of KI and 800 ml of a 5% aqueous solution of low-molecular weight gelatin were added at a fixed flow rate over 60 minutes. The fine grain emulsion formed in the mixer was continuously charged in the reaction vessel. The stirrer of the mixer was rotated at 2000 rpm (grain growth).

During grain growth, $8\times10^{-8}$ mol/molAg of $IrC_6$ was doped into the mixture when addition of silver nitrate was completed 70%. Prior to the completion of the grain growth, yellow prussiate of potash was charged in the mixer. The yellow prussiate of potash was doped into 3% of the shell portion of the grains to give a local concentration of $3\times10^{-4}$ mol/molAg (in terms of the amount of silver added). After completion of the addition, the emulsion was cooled to 35° C., washed with water by normal flocculation, and added with 70 g of lime-treated ossein gelatin to dissolve the gelatin in the emulsion. The resulting solution was then adjusted to pAg of 8.7 and pH of 6.5, followed by refrigeration. Properties of the tabular grains thus obtained are shown in Table 1.

Emulsion 1-B (Invention)

In the same manner as that employed for Emulsion 1-A except that nucleus formation was conducted as described below instead, Emulsion 1-B was prepared.

As the mixer, a microreactor (Interdigital single mixing device) manufactured by IMM (Institute fur Mikrotechnik Mianz) was employed. The aqueous silver nitrate solution and KBr solution were charged in the microreactor through a syringe pump.

TABLE 1

| Emulsion | Equivalent-circle diameter (μm) | Coefficient of variation of equivalent-circle diameter (%) | Average thickness (μm) | Ratio of tabular grains (%) | Details |
|---|---|---|---|---|---|
| 1-A | 1.3 | 21 | 0.045 | 98 | Comparison |
| 1-B | 1.4 | 18 | 0.045 | 99 | Invention |

As is apparent from the results of Table 1, it reveals that the size distribution of tabular grains decreases in the case of the present invention.

To each of Emulsions 1-A and 1-B prepared in Example 1, $2.4\times10^{-4}$ mol/mol-Ag of the below-described compound was added at 40° C., followed by the addition of sodium thiosulfate, potassium chloroaurate and potassium thiocyanate to optimally and chemically sensitize the mixture at 60° C.

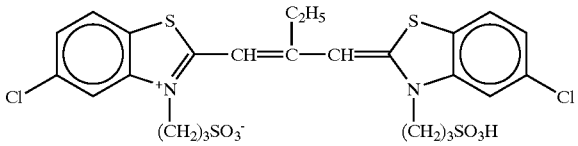

Each of the resulting emulsions and a protective layer were coated, under the below-described conditions, onto a cellulose triacetate film support having an undercoat layer, whereby a coating sample was prepared.

Emulsion Coating Conditions (1) Emulsion layer

Emulsion . . . various emulsions (silver $3.6\times10^{-2}$ mol/m$^2$)

The following coupler ($1.5\times10^{-3}$ mol/m$^2$)

(Compound)

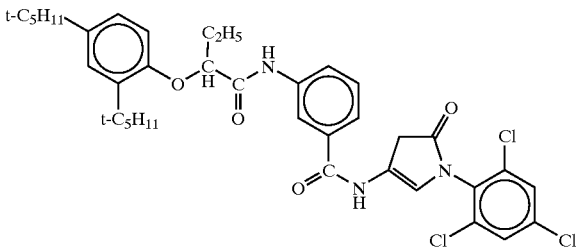

Tricresyl phosphate (1.10 g/m$^2$)

Gelatin (2.30 g/m$^2$)

(2) Protective layer 2,4-Dichloro-6-hydroxy-s-triazine sodium salt (0.08 g/m$^2$)

Gelatin (1.80 g/m$^2$)

These samples were allowed to stand at 40° C. and a relative humidity of 70% for 14 hours, followed by exposure for 1/100 sec through a yellow filter and a continuous wedge. The below-described color development was conducted.

Color Development

| Step | Time | Temperature |
|---|---|---|
| Color development | 2 min 00 sec | 40° C. |
| Bleach fixing | 3 min 00 sec | 40° C. |
| Water washing (1) | 20 sec | 35° C. |
| Water washing (2) | 20 sec | 35° C. |
| Stabilization | 20 sec | 35° C. |
| Drying | 50 sec | 65° C. |

The compositions of the processing solutions are presented below.

| | (unit: g) |
|---|---|
| (Color developer) | |
| Diethylenetriamine pentaacetic acid | 2.0 |
| Sodium 1-Hydroxyethylidene-1,1-disulfonesulfite | 4.0 |
| Potassium carbonate | 30.0 |
| Potassium bromide | 1.4 |
| Potassium iodide | 1.5 mg |
| Hydroxyaminesulfuric acid | 2.4 |
| 4-[N-Ethyl-N-β-hydroxyethylamino]-2-methylaniline sulfate | 4.5 |
| Water to make | 1.0 L |
| pH | 10.05 |
| (Bleach fixing solution) | |
| Ferric ammonium ethylenediaminetetraacetate dihydrate | 90.0 |
| Disodium ethylenediaminetetraacetate | 5.0 |
| Sodium sulfite | 12.0 |
| Aq. soln (70%) of ammonium thiosulfate | 260.0 ml |
| Acetic acid (98%) | 5.0 ml |
| The below-described bleaching accelerator | 0.01 mol |

-continued

| | (unit: g) |
|---|---|
| 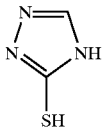 | |
| (Bleaching accelerator) | |
| Water to make | 1.0 L |
| pH | 6.0 |
| (Washing water) | |

Tap water was supplied to a mixed-bed column filled with an H type cation exchange resin ("Amberlite IR-120B", trade name; product of Rohm & Haas Co.) and an OH type anion exchange resin ("Amberlite IR-400", trade name; product of the same company) to give 3 mg/L or less as each of the concentrations of calcium and magnesium. Subsequently, 20 mg/L of sodium dichloro-isocyanurate and 1.5 g/L of sodium sulfate were added.

The pH of the solution ranges from 6.5 to 7.5.

| (Stabilizer) | (unit: mg) |
|---|---|
| Formalin (37%) | 2.0 ml |
| Polyoxyethylene-p-monononyl phenyl ether (average polymerization degree 10) | 0.3 |
| Disodium ethylenediaminetetraacetate | 0.05 |
| Water to make | 1.0 L |
| pH | 5.0 to 8.0 |

The results are shown in Table 2. The sensitivity is indicated by the relative value of the reciprocal of an exposure amount expressed by lux·sec giving a density of fog density plus 0.1.

TABLE 2

| Emulsion | Sensitivity | Fogging | Gradation | |
|---|---|---|---|---|
| 1-A | 100 | 0.06 | 1.7 | Comparison |
| 1-B | 103 | 0.06 | 1.9 | Invention |

As is apparent from the results of Table 2, the emulsion of the present invention exhibits a high gradation. This heightening of gradation owes to the results of narrowing of the size distribution of the tubular grains.

Emulsion 1-B according to the present invention can be suitably used for a high-speed color negative photosensitive material.

Example 2

Preparation of Emulsion B-1

Without charging nothing in a reaction vessel, 700 ml of an aqueous solution containing 0.11 mol of silver nitrate and 700 mol of an aqueous solution containing 0.13 mol of sodium chloride and 3.2 g of lime-treated gelatin (average molecular weight of 100,000) were added successively over 27 minutes to a mixer (having an internal volume of 0.5 ml) as illustrated in FIG. 1 of Japanese Patent Application (Laid-Open) No. 239787/1998. The resulting emulsion was continuously charged in the reaction vessel over 27 minutes, whereby 1400 ml of a fine grain emulsion was obtained. Upon this mixing, the stirrer of the mixer was rotated at a frequency of 2000 rpm. In this manner, nucleation was conducted. Immediately after nucleation, the pH was adjusted to 5.5. One minute later, an aqueous solution containing 0.9 mmol of Crystal habit-controlling agent 1 was added. Further one minute later, an aqueous solution containing 34 g of phthalated gelatin and 2.0 g of sodium chloride was added. The temperature of the reaction vessel was then increased to 55° C. over 25 minutes and at this temperature, physical ripening was conducted for 30 minutes. An aqueous solution containing 1.23 mol of silver nitrate, an aqueous solution containing 1.31 mol of sodium chloride and an aqueous solution containing 2.1 mol of Crystal habit-controlling agent 1 were added simultaneously over 27 minutes while accelerating the flow rate. Up to this step, addition of 80% of the necessary amount of silver nitrate was completed. An aqueous solution containing 0.33 mol of silver nitrate and an aqueous solution containing 0.33 mol of sodium chloride were added simultaneously over 10 minutes, whereby the addition of the necessary amount of silver nitrate was completed. When the addition amount of silver nitrate reached 80% to 90%, potassium bromide was added to give 2 mol % per mol of the resulting silver halide while stirring vigorously. When the addition amount of silver nitrate reached 80% to 90%, an aqueous solution of $K_4[Ru(CN)_6]$ was added to give an Ru amount of $3\times10^{-5}$ mol per mol of the resulting silver halide. When the addition amount of silver nitrate reached 83% to 88%, an aqueous solution of $K_2[IrCl_6]$ was added to give an Ir amount of $3\times10^{-8}$ mol per mol of the resulting silver halide. When 90% of the addition of silver nitrate was completed, an aqueous solution of potassium iodide was added to give an Ir amount of 0.4 mol % per mol of the resulting silver halide while vigorously stirring. When the addition amount of silver nitrate reached 92% to 98%, an aqueous solution of $K_2[Ir(5\text{-methylthiazole})Cl_5]$ was added to give an Ir amount of $1\times10^{-6}$ mol per mol of the resulting silver halide. After completion of the addition of silver nitrate, the temperature was raised to 75° C. and Sensitizing dye A and Sensitizing dye B were added in amounts of $5\times10^{-4}$ mol and $2.5\times10^{-4}$ mol, per mol of the resulting silver halide, respectively, followed by ripening for 20 minutes. After desalting at 30° C., 130 g of lime-treated gelatin was added to adjust its pH to 6.3 and pCl to 2.0. The emulsion thus obtained was a tabular silver iodobromochloride emulsion having an average equivalent-sphere diameter of 0.57 μm and in this emulsion, 96% of the projected area of all the silver halide grains were tabular grains having {111} faces as main surfaces.

The resulting emulsion was dissolved at 40° C., followed by the addition of $3\times10^{-5}$ mol of sodium thiosulfonate per mol of a silver halide. Using sodium thilsulfate 5 hydrate as a sulfur sensitizer and (S-2) as a gold sensitizer, the mixture was ripened at 60° C. to be optimum. After cooling to 40° C., 1-phenyl-5-mercaptotetrazole and 1-(5-methylureidophenyl)-5-mercaptotetrazole were each added in an amount of $4.7\times10^{-4}$ Mol per mol of a silver halide. The emulsion thus obtained was designated as Emulsion B-1.

Crystal Habit-Controlling Agent 1

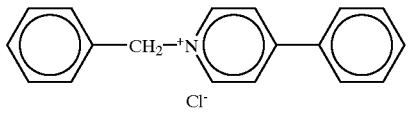

-continued (Sensitizing dye A)

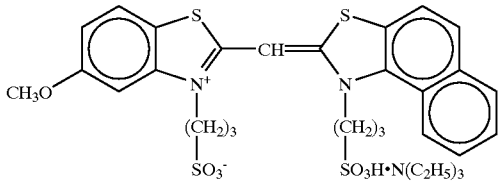

(Sensitizing dye B)

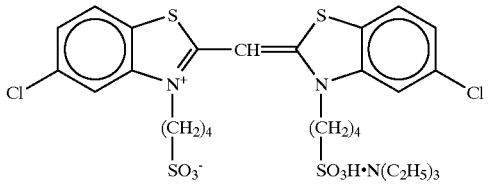

(S-2)

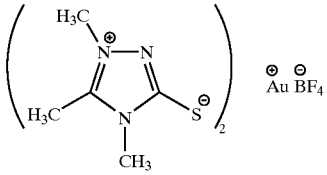

Preparation of Emulsion B-2

In the same manner as that employed for preparation of Emulsion B-1 except that nucleation was conducted as described below, Emulsion B-2 was prepared. As the mixer, a microreactor made by IMM was employed. An aqueous solution of silver nitrate and an aqueous solution of sodium chloride were charged in the microreactor through a syringe pump.

The emulsion thus prepared was a tabular silver iodobromochloride emulsion wherein 97% of the projected area of all the silver halide grains were constituted of tabular grains having {111} faces as main surfaces and it had an average equivalent-sphere diameter of 0.57 μm. The properties of the tabular grains are shown in Table 1. It reveals that the grain size distribution of the tabular grains is narrowed in the present invention.

TABLE 3

| Emulsion | Equivalent-circle diameter (μm) | Coefficient of variation of equivalent-circle diameter (%) | Average thickness (μm) | Ratio of tabular grains (%) | Details |
|---|---|---|---|---|---|
| B-1 | 0.99 | 22 | 0.125 | 96 | Comparison |
| B-2 | 0.98 | 18 | 0.123 | 97 | Invention |

Preparation of Emulsion G-1

To 1000 ml of a 3% aqueous solution of lime-treated gelatin adjusted to pH of 5.5 and pCl of 1.7, an aqueous solution containing 2.12 mol of silver nitrate and an aqueous solution of 2.2 mol of sodium chloride were added and mixed simultaneously at 45° C. while stirring vigorously. When the addition amount of silver nitrate reached 80% to 90%, an aqueous solution of $K_4[Ru(CN)_6]$ was added to give an Ru amount of $3\times10^{-5}$ mol per mol of the resulting silver halide. When the addition amount of silver nitrate reached 83% to 88%, an aqueous solution of $K_2[IrCl_6]$ was added to give an Ir amount of $5\times10^{-8}$ mol per mol of the resulting silver halide. When the addition amount of silver nitrate reached 92% to 95%, an aqueous solution of $K_2[Ir(5\text{-methylthiazole})Cl_5]$ was added to give an Ir amount of $5\times10^{-7}$ mol per mol of the resulting silver halide. After desalting at 40° C., 168 g of lime-treated gelatin was added to adjust its pH to 5.5 and pCl to 1.8. The emulsion thus obtained was a cubic silver chloride emulsion having an equivalent-sphere diameter of 0.35 μm and a coefficient of variation of 10%.

The resulting emulsion was dissolved at 40° C., followed by the addition of $2\times10^{-5}$ mol of sodium thiosulfonate per mol of a silver halide. Using sodium thilsulfate 5 hydrate as a sulfur sensitizer and (S-2) and as a gold sensitizer, the mixture was ripened at 60° C. to be optimum. After cooling to 40° C., Sensitizing dye D, 1-phenyl-5-mercaptotetrazole, 1-(5-methylureidophenyl)-5-mercaptotetrazole and potassium bromide were added in amounts of $6\times10^{-4}$ mol, $2\times10^{-4}$ mol, $8\times10^{-4}$ and $7\times10^{-3}$ each per mol of a silver halide. The emulsion thus obtained was designated as Emulsion G-1.

(Sensitizing dye D)

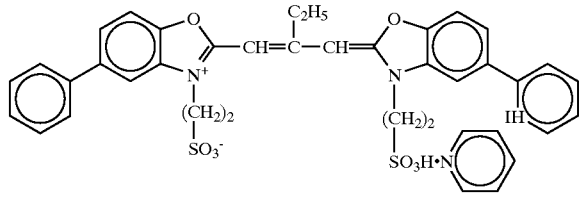

Preparation of Emulsion R-1

To 1000 ml of a 3% aqueous solution of lime-treated gelatin adjusted to pH of 5.5 and pCl of 1.7, an aqueous solution containing 2.12 mol of silver nitrate and an aqueous solution of 2.2 mol of sodium chloride were added and mixed simultaneously at 45° C., while stirring vigorously. When the addition amount of silver nitrate reached 80% to 100%, potassium bromide was added to give its amount of 4 mol % per mol of the resulting silver halide while mixing vigorously. When the addition amount of silver nitrate reached 80% to 90%, an aqueous solution of $K_4[Ru(CN)_6]$ was added to give an Ru amount of $3\times10^{-5}$ mol per mol of the resulting silver halide. When the addition amount of silver nitrate reached 83% to 88%, an aqueous solution of $K_2[IrCl_6]$ was added to give an Ir amount of $5\times10^{-8}$ mol per mol of the resulting silver halide. When 90% of the addition of silver nitrate was completed, an aqueous solution of potassium iodide was added to give an I amount of 0.1 mol % per mol of the resulting silver halide while mixing vigorously. When the addition amount of silver nitrate reached 92% to 95%, an aqueous solution of $K_2[Ir(5\text{-methylthiazole})Cl_5]$ was added to give an Ir amount of $5\times10^{-7}$ mol per mol of the resulting silver halide. When the addition amount of silver nitrate reached 95% to 98%, an aqueous solution of $K_2[Ir(H_2O)Cl_5]$ was added to give an Ir amount of $5\times10^{-7}$ mol per mol of the resulting silver halide. After desalting at 40° C., 168 g of lime-treated gelatin was added to adjust its pH to 5.5 and pCl to 1.8. The emulsion thus obtained was a cubic silver iodobromochloride emulsion having an equivalent-sphere diameter of 0.35 μm and a coefficient of variation of 10%.

The resulting emulsion was dissolved at 40° C., followed by the addition of $2\times10^{-5}$ mol of sodium thiosulfonate per mol of a silver halide. Using sodium thilsulfate 5 hydrate as a sulfur sensitizer and (S-2) as a gold sensitizer, the mixture was ripened at 60° C. to be optimum. After cooling to 40° C., Sensitizing dye H, 1-phenyl-5-mercaptotetrazole, 1-(5-methylureidophenyl)-5-mercaptotetrazole, Compound I and potassium bromide were added in amounts of $2\times10^{-4}$ mol, $2\times10^{-4}$ mol, $8\times10^{-4}$ mol. $1\times10^{-3}$ mol and $7\times10^{-3}$ mol, per mol of a silver halide, respectively. The emulsion thus obtained was designated as Emulsion R-1.

(Sensitizing dye H)

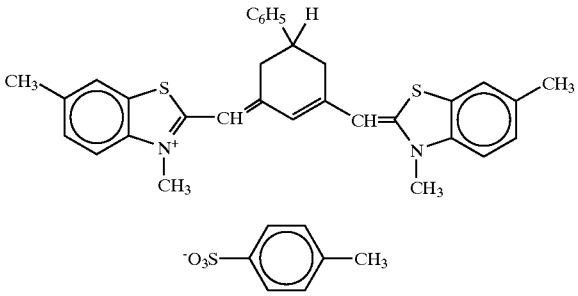

(Compound I)

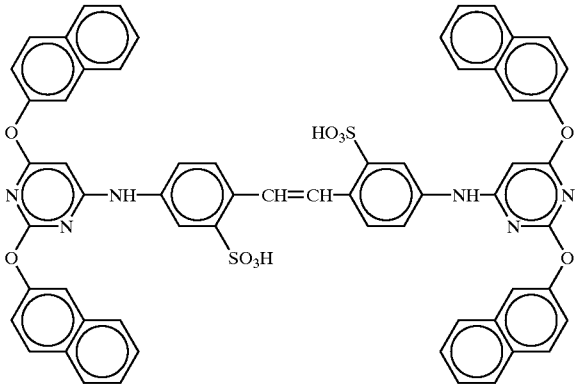

The surface of a support made of paper having both sides covered with a polyethylene resin was subjected to corona discharge. After formation of a gelatin undercoat layer containing sodium dodecylbenzenesulfonate, photographic constitution layers from first layer to seventh layer were successively formed, whereby a sample of a silver halide color photosensitive material having the layers described below was prepared. Each of the coating solutions for photographic constitution layers was prepared in the following manners.

Preparation of a First-Layer Coating Solution

In 21 g of Solvent (Solv-1) and 80 ml of ethyl acetate were dissolved 57 g of Yellow coupler (E×Y), 7 g of Color image stabilizer (Cpd-1), 4 g of Color image stabilizer (Cpd-2), 7 g of Color image stabilizer (Cpd-3) and 2 g of Color image stabilizer (Cpd-8). The resulting solution was emulsified and dispersed in 220 g of a 23.5 wt. % of an aqueous gelatin solution containing 4 g of sodium dodecylbenzenesulfonate in a high-speed stirring emulsifying machine (dissolver). Water was then added to prepare 900 g of Emulsified dispersion A.

Emulsified dispersion A and Emulsion B-1 were mixed and dissolved to prepare the first-layer coating solution to have the below-described composition. The coating amount of the emulsion means the amount in terms of a silver amount.

Coating solutions for second layers to seventh layers were prepared in the same manner as that employed for the first-layer coating solution. As a gelatin hardening agent for each layer, employed were 1-oxy-3,5-dichloro-s-triazine sodium salts (H-1), (H-2) and (H-3). To each layer, Ab-1, Ab-2, Ab-3 and Ab-4 were added so that the total amounts would be 15.0 mg/m$^2$, 60.0 mg/m$^2$, 5.0 mg/m$^2$ and 10.0 mg/m$^2$, respectively.

(H-1) Film hardener

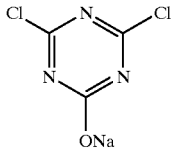

(use of 1.4 wt.% of gelatin)

(H-2) Film hardener

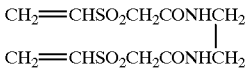

(H-3) Film hardener

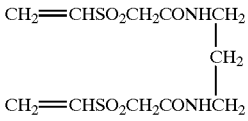

(Ab-a) Antiseptic

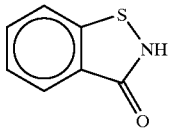

(Ab-2) Antiseptic

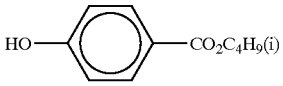

(Ab-3) Antiseptic

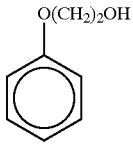

(Ab-4) Antiseptic

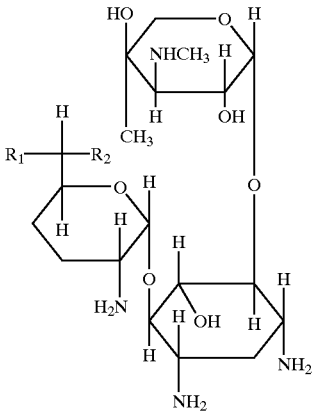

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A 1:1:1:1 (molar ratio) mixture of a, b, c, and d

To a green-sensitive emulsion layer and a red-sensitive emulsion layer, 1-phenyl-5-mercaptotetrazole was added in amounts of $1.0\times10^{-3}$ mol and $5.9\times10^{-4}$ mol, each per mol of a silver halide, respectively. To the second layer, fourth layer and sixth layer, 1-phenyl-5-mercaptotetrazole was added to give its amount of 0.2 mg/m$^2$, 0.2 mg/m$^2$ and 0.6 mg/M$_2$, respectively.

To the red-sensitive emulsion layer was added 0.05 g/M$^2$ of a methacrylic acid/butyl methacrylate copolymer latex (weight ratio (i.e., mass ratio):1:1, average molecular weight of 200,000 to 400,000). To the second layer, fourth layer and sixth layer, disodium catechol-3,5-disulfonate was added in amounts of 6 mg/m$^2$, 6 mg/m$^2$ and 18 mg/m$^2$, respectively. Irradiation was prevented by adding the following dyes (numerals in parentheses represent the coating amount).

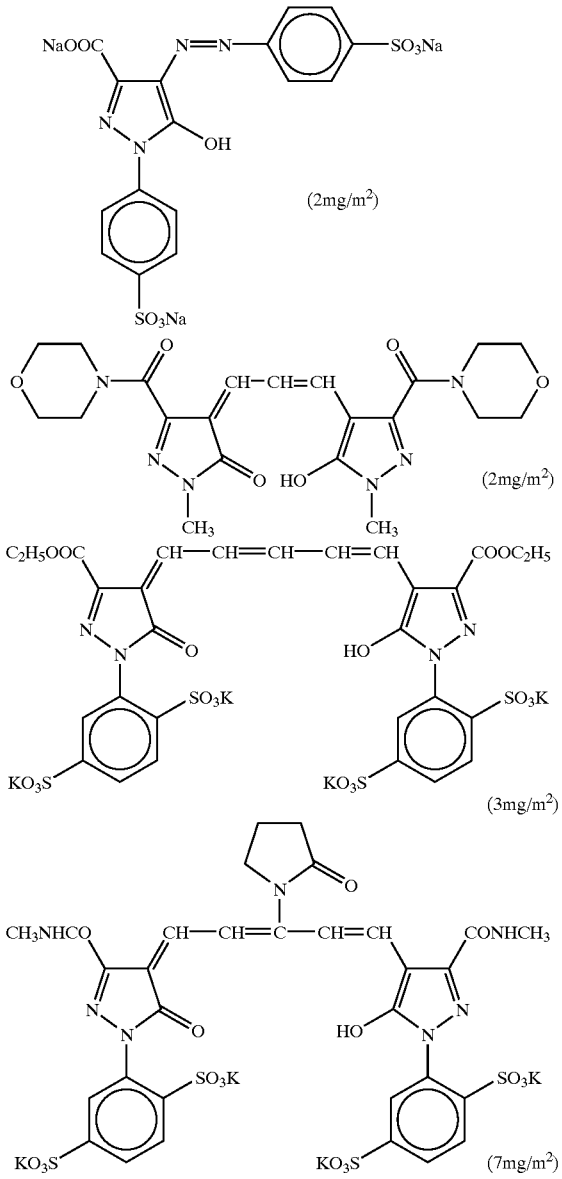

Layer Constitution

The constitution of each of the layers will next be described. Numerals indicate the coating amount (g/m$^2$). The amount of a silver halide emulsion is indicated in terms of silver.

Support: polyethylene resin laminate paper

[The polyethylene resin on the side of the first layer contains a white pigment (containing 16 wt. % of $TiO_2$ and 4 wt. % of ZnO) and a fluorescent brightening agent (containing 0.03 wt %. of 4,4'-bis(5-methylbenzoxazolyl) stilbene), and a bluish dye (marineblue)

| | |
|---|---|
| First layer (blue-sensitive emulsion layer) | |
| Emulsion B-1 | 0.20 |
| Gelatin | 1.00 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (color-mixing preventive layer) | |
| Gelatin | 0.80 |
| Color-mixing preventing agent (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third layer (green-sensitive emulsion layer) | |
| Emulsion G-1 | 0.14 |
| Gelatin | 1.36 |
| Magenta coupler (ExM) | 0.15 |
| Ultraviolet absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (color-mixing preventive layer) | |
| Gelatin | 0.71 |
| Color-mixing preventing agent (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth layer (red-sensitive emulsion layer) | |
| Emulsion R-1 | 0.12 |
| Gelatin | 1.11 |
| Cyan coupler (Exc-2) | 0.13 |
| Cyan coupler (Exc-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth layer (ultraviolet absorbing layer) | |
| Gelatin | 0.46 |
| Ultraviolet absorbent (UV-B) | 0.45 |
| Compound (S1-4) | 0.0015 |
| Solvent (Solv-7) | 0.25 |

-continued

| Seventh layer (protective layer) | |
|---|---|
| Gelatin | 1.00 |
| Acrylic-modified copolymer of polyvinyl alcohol (modification degree: 17%) | 0.04 |
| Liquid paraffin | 0.02 |
| Surfactant (Cpd-13) | 0.01 |

(ExY) Yellow coupler

A 70:30 (molar ratio) mixture of

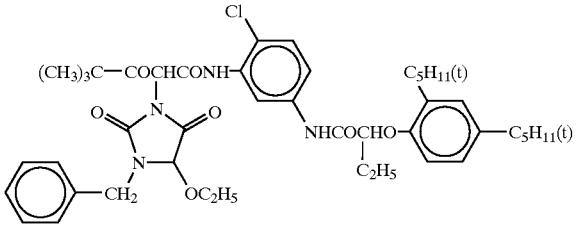

and

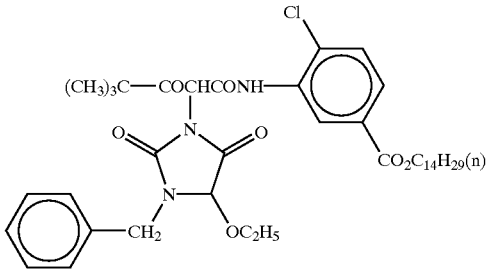

(ExM) Magenta coupler

A 40:40:20 (molar ratio) mixture of

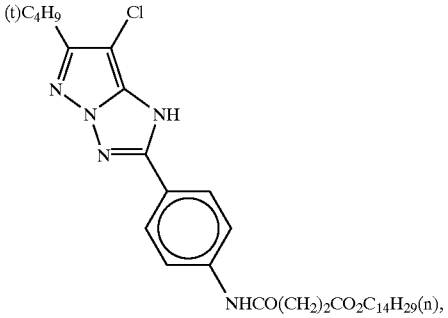

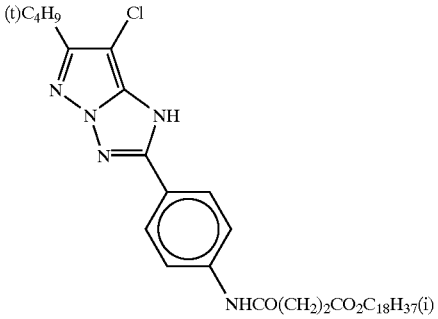

and

-continued

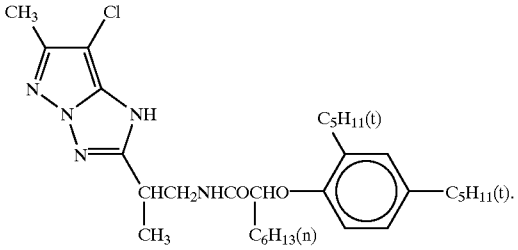

(ExC-2) Cyan coupler

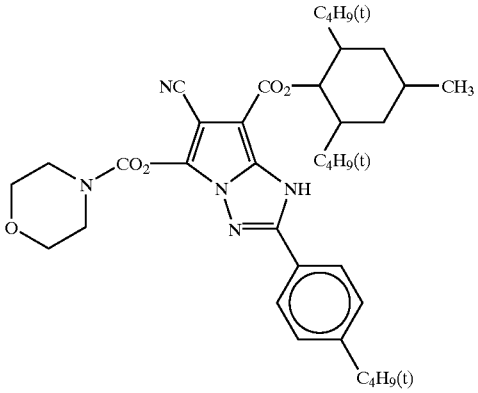

(ExC-3) Cyan coupler

A 50:25:25 (molar ratio) mixture of

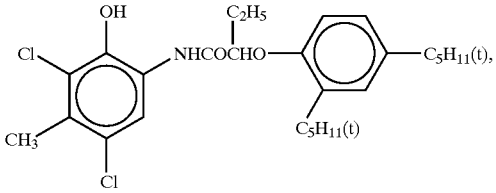

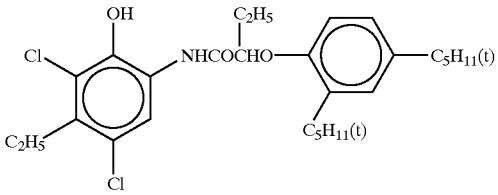

and

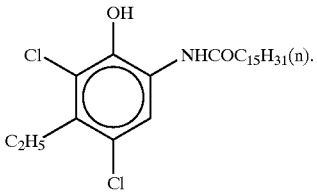

(Cpd-1) Color image stabilizer

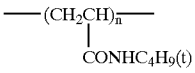

Number-average molecular weight: 60,000

-continued (Cpd-2) Color image stabilizer

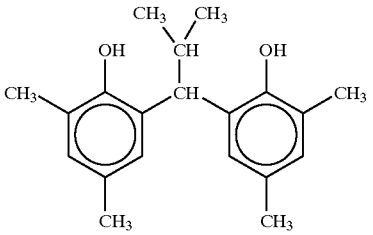

(Cpd-3) Color image stabilizer

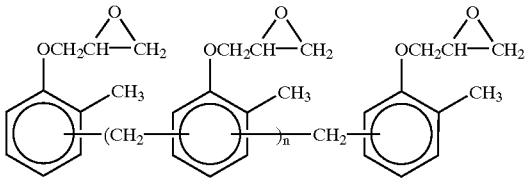

n = 7 to 8 (mean)

(Cpd-4) Color image stabilizer

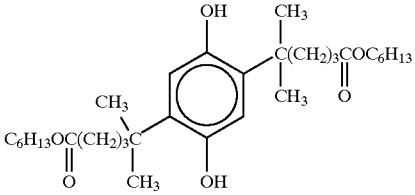

(Cpd-5) Color image stabilizer

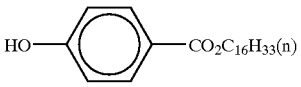

(Cpd-6) Color image stabilizer

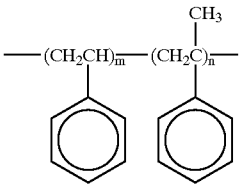

Number-average molecular weight: 600, m/n = 10/9

(Cpd-7) Color image stabilizer

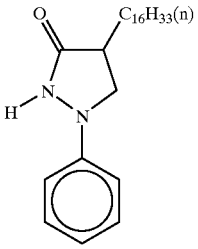

(Cpd-8) Color image stabilizer

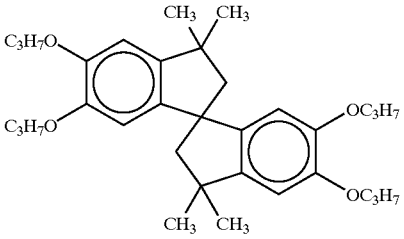

-continued (Cpd-9) Color image stabilizer

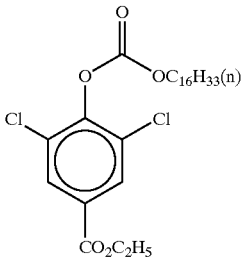

(Cpd-10) Color image stabilizer

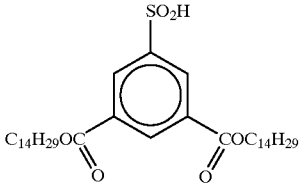

(Cpd-11)

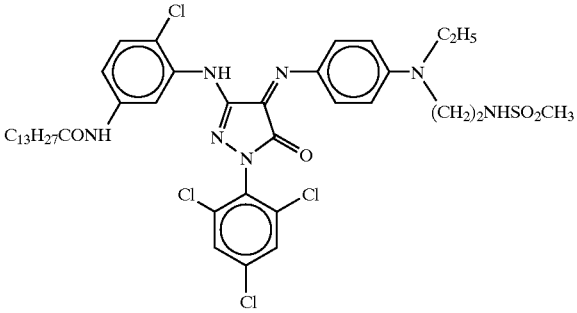

(Cpd-13) Surfactant

A 7:3 (molar ratio) mixture of

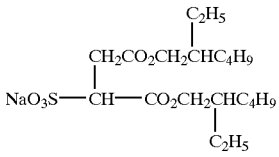

and

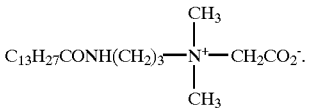

(Cpd-14)

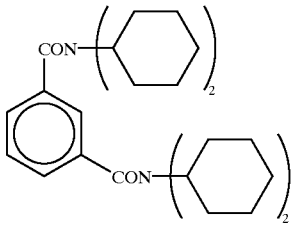

(Cpd-15)

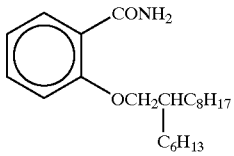

-continued (Cpd-16)

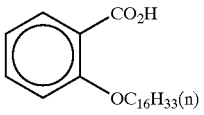

(Cpd-17)

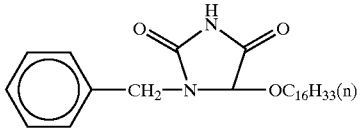

(Cpd-18)

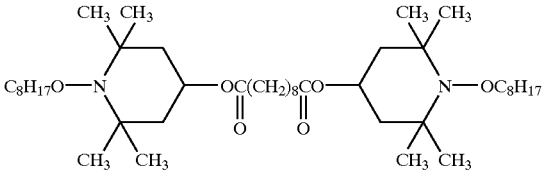

(Cpd-19) Color-mixing preventive

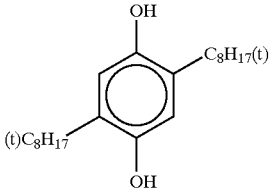

(UV-1) Ultraviolet absorbent

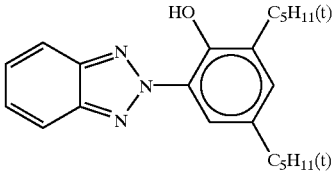

(UV-2) Ultraviolet absorbent

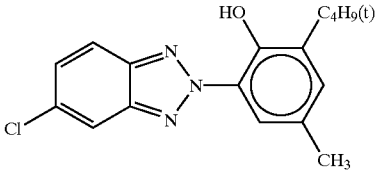

(UV-3) Ultraviolet absorbent

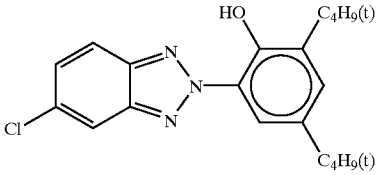

(UV-4) Ultraviolet absorbent

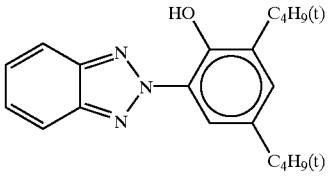

-continued (UV-5) Ultraviolet absorbent

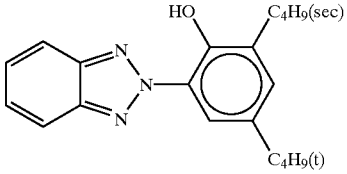

(UV-6) Ultraviolet absorbent

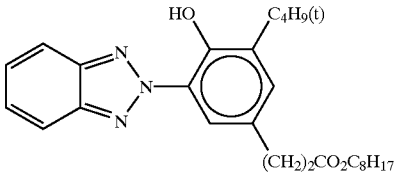

(UV-7) Ultraviolet absorbent

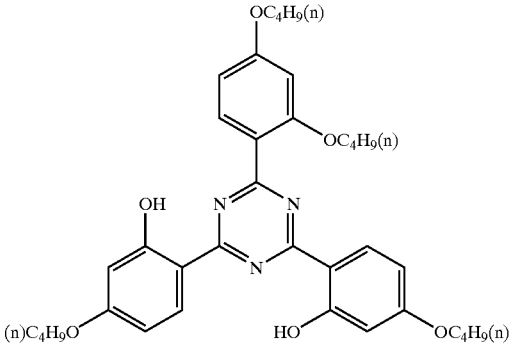

UV-A: A 4:2:2:3 (weight ratio) mixture of UV-1, UV-2, UV-3, and UV-4

UV-B: A 9:3:3:4:5:3 (weight ratio) mixture of UV-1, UV-2, UV-3, UV-4, UV-5 and UV-6.

UV-C: a 1:1:1:2 (weight ratio) mixture of UV-2, UV-3, UV-6 and UV-7.

(Solv-1)

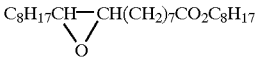

(Solv-2)

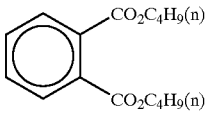

(Solv-3)

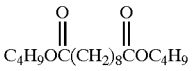

(Solv-4)

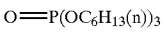

(Solv-5)

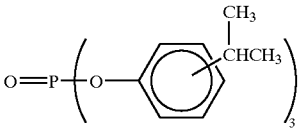

(Solv-7)

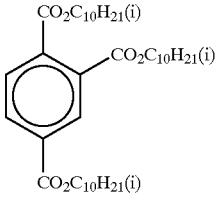

-continued (Solv-8)

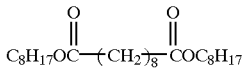

(S1-4)

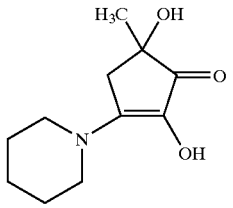

The sample thus obtained was designated as Sample 101. In the same manner except for the use of Emulsion B-2 instead of Emulsion B-1 of the blue-sensitive emulsion layer, a sample was prepared and it was designated as Sample 102.

Photographic properties of these samples were evaluated by the following experiment.

To each coating sample, gradation exposure for sensitometry was given by using a high-illumination exposure photosensitometer ("HIE" manufactured by Yamashita Denso Corp.). It was exposed with "SP-1 Filter" of Fuji Photo Film Co., Ltd. for $10^{-6}$ second at a high illumination.

The exposure was followed by color developing treatment A as described below.

The processing is conducted in the following manner.

Processing Step A

The photosensitive material sample was processed into a roll of 127 mm wide. After exposure by using "Minilaboprinter processer PP1258Ar" (trade name; manufactured by Fuji Photo Film Co., Ltd.), the roll was subjected to continuous processing (running test) having the following steps until twice as much as the color development tank capacity was replenished. The processing with this running liquid was designated as Processing A.

| Processing step | Temperature | Time | Replenished amount* |
|---|---|---|---|
| Color development | 38.5° C. | 45 sec | 45 mL |
| Bleach fixing | 38.0° C. | 45 sec | 35 mL |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 mL |

*: Replenished amount per 1 $m^2$ of a photosensitive material

**: "Rinse cleaning system RC50D" (trade name, manufactured by Fuji Photo Film Co., Ltd.) was installed for Rinse (3), and the rinse solution was taken out from Rinse (3) and was then, pumped to a reverse osmosis membrane module (RC50D) by a pump. The permeated water obtained in that tank was fed to Rinse (4), and the concentrated water was returned to Rinse (3). The pump pressure was adjusted so that the amount of the permeated water to the reverse osmosis membrane module would be kept at 50 to 300 mL/min, and circulation was conducted under temperature control for 10 hours per day. (The rinse was of a tank counter-current system from (1) to (4).)

The composition of each processing solution was as follows:

| [Color development solution] | [Tank solution] | [Replenishment solution] |
|---|---|---|
| Water | 800 mL | 800 mL |
| Dimethylpolysiloxane surfactant ("Silicone KF351A", trade name; product of Shin-etsu Chemical Industry) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene fluorscent brightening agent ("Hakkhol FWA-SF", trade name; product of Showa Chemical Industry) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-amino-4-aminoaniline.3/2 sulfuric acid. monohydrate | 5.0 g | 15.7 g |
| Potassium carbonate | 26.3 g | 26.3 g |
| Water | to make 1000 mL | to make 100 mL |
| pH (25° C./regulated by potassium hydroxide or sulfuric acid | 10.15 | 12.50 |

| Bleach fixing solution | Tank solution | Replenished solution |
|---|---|---|
| Water | 700 mL | 600 mL |
| Ammonium iron (III) ethylenediaminetetraacetate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/L) | 107.0 mL | 214.0 mL |
| Ammonium sulfite | 16.0 g | 32.0 g |
| Ammonium bisulfite | 23.1 g | 246.2 g |
| Water | to make 1000 mL | to make 1000 mL |
| pH (at 25° C./regulated by acetic acid or ammonia) | 6.0 | 6.0 |

| Rinse solution | Tank solution | Replenisher |
|---|---|---|
| Sodium chlorinated isocyanurate | 0.02 g | 0.02 g |
| Deionized water (conductivity: 5 μS/cm or less) | to make 1000 mL | to make 1000 mL |
| pH (at 25° C.) | 6.5 | 6.5 |

The yellow color forming density of each sample after processing was measured and a characteristic curve of exposure to high illumination for $10^{-6}$ sec was obtained. The sensitivity was defined by the reciprocal of an exposure amount giving a color forming density higher by 1.5 than the minimum color forming density and it was expressed by a value relative to the sensitivity of the sample 101 set at 100. From an inclination of a line connecting the point showing the density of 1.5 and the point showing the density of 2.0, gradation was determined and it was expressed as a value relative to the gradation of the sample 101 set at 100. The smaller the minimum color-forming density, the better. The greater the sensitivity and gradation, the better. The results are shown in Table 4.

TABLE 4

| Sample No. | Minimum color-forming density | Sensitivity | Gradation |
|---|---|---|---|
| 101 | 0.070 | 100 | 100 |
| 102 | 0.068 | 105 | 115 |

As is apparent from the results of Table 4, a photosensitive material exhibiting a high contrast (i.e., a hard gradation) was obtained using the emulsion of the present invention. This is presumed to be brought about by the effects of mono-dispersion of the tabular grains.

Example 3

A thin-layered sample was prepared with the following layer composition different from that of the sample of Example 1.

Preparation of the Sample

| | |
|---|---|
| First layer (blue-sensitive emulsion layer) | |
| Emulsion B-1 | 0.12 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| Second layer (color-mixing preventive layer) | |
| Gelatin | 0.5 |
| Color-mixing preventing agent (Cpd-19) | 0.07 |
| Color image stabilizer (Cpd-5) | 0.006 |
| Color image stabilizer (Cpd-7) | 0.006 |
| Ultraviolet absorbent (UV-C) | 0.04 |
| Solvent (Solv-5) | 0.19 |
| Third layer (green-sensitive emulsion layer) | |
| Emulsion G-1 | 0.14 |
| Gelatin | 0.73 |
| Magenta coupler (ExM) | 0.15 |
| Ultraviolet absorbent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| Fourth layer (color-mixing preventive layer) | |
| Gelatin | 0.48 |
| Color-mixing preventing agent (Cpd-4) | 0.07 |
| Color image stabilizer (Cpd-5) | 0.006 |
| Color image stabilizer (Cpd-7) | 0.006 |
| Ultraviolet absorbent (UV-C) | 0.04 |
| Solvent (Solv-5) | 0.09 |
| Fifth layer (red-sensitive emulsion layer) | |
| Emulsion R-1 | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |

-continued

| | |
|---|---|
| Color image stabilizer (Cpd-18) | 0.04 |
| Ultraviolet absorbent (UV-7) | 0.02 |
| Solvent (Solv-5) | 0.09 |
| Sixth layer (ultraviolet absorbing layer) | |
| Gelatin | 0.32 |
| Ultraviolet absorbent (UV-C) | 0.42 |
| Solvent (Solv-7) | 0.08 |
| Seventh layer (protective layer) | |
| Gelatin | 0.70 |
| Acrylic-modified copolymer of polyvinyl alcohol (modification degree: 17%) | 0.04 |
| Liquid paraffin | 0.01 |
| Surfactant (Cpd-13) | 0.01 |
| Polydimethylsiloxane | 0.01 |
| Silicon dioxide | 0.003 |

(ExY-2)

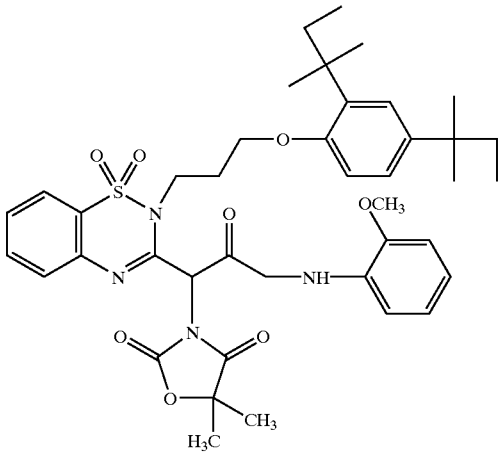

The sample using Emulsion B-1 as an emulsion of a blue-sensitive emulsion layer was designated as Sample 201. In the same manner as the above except for the use of Emulsion B-2 instead of Emulsion B-1 for the blue-sensitive emulsion layer of Sample 201, a sample was prepared and it was designated as Sample 202.

Photographic properties of these samples were evaluated by the following experiment.

To each coating sample, gradation exposure for sensitometry was given using a high-illumination exposure photosensitometer ("HIE Model", manufactured by Yamashita Denso). "SP-1 Filter" (trade name; product of Fuji Photo Film) was installed, followed by exposure at a high Lillumination for $10^{-6}$ sec.

The sample thus exposed was subjected to ultra-rapid color development processing in accordance with the following Development B.

Processing B

The photosensitive material sample was formed into a roll of 127 mm wide. From a negative film having an average density, the photosensitive material sample was exposed imagewise by using an experimental processor obtained by altering a "Minilab series printer processor PP350" (manufactured by Fuji Photo Film Co., Ltd.) so that the processing time and processing temperature can be set freely. The roll was then subjected to continuous processing (running test) until the amount of the color development replenisher used in the following processing step would be 0.5 time as much as that of the capacity of the color development tank.

| Processing step | Temperature | Time | Replenished amount* |
|---|---|---|---|
| Color development | 45.0° C. | 15 sec | 45 mL |
| Bleach fixing | 40.0° C. | 15 sec | 35 mL |
| Rinse (1) | 40.0° C. | 8 sec | — |
| Rinse (2) | 40.0° C. | 8 sec | — |
| Rinse (3) | **40.0° C. | 8 sec | — |
| Rinse (4) | 38.0° C. | 8 sec | 121 mL |
| Drying | 80.0° C. | 15 sec | |

(Note)
*: Replenished amount per 1 $m^2$ of a photosensitive material
**: "Rinse cleaning system RC50D" (trade name, manufactured by Fuji Photo Film Co., Ltd.) was installed for Rinse (3) , and the rinse solution was taken out from Rinse (3) and was then, pumped to a reverse osmosis membrane module (RC50D) by a pump. The permeated water fed to that tank was then fed to Rinse (4), and the concentrated water was returned to Rinse (3). The pump pressure was adjusted so that the amount of the permeated water to the reverse osmosis membrane module would be kept at 50 to 300 mL/min, and circulation was conducted under temperature control for 10 hours per day. The rinse was of a tank counter-current system from (1) to (4).

The composition of each processing solution was as follows:

| | [Tank solution] | [Replenisher] |
|---|---|---|
| [Color development solution] | | |
| Water | 800 mL | 600 mL |
| Fluorescent brightening agent (FL-1) | 5.0 g | 8.5 g |
| Triisopropanolamine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.5 g |
| 4-Amino-3-methyl-N-ethyl-N-(β-methanesulfonamidoethyl)aniline. 3/2 sulfate.monohydrate | 1.0 g | 22.0 g |
| Potassium carbonate | 26.3 g | 26.3 g |
| Water | to make 1000 mL | to make 1000 mL |
| pH (25° C./regulated by sulfuric acid or KOH) | 10.35 | 12.6 |
| [Bleach fixing solution] | | |
| Water | 800 mL | 800 mL |
| Ammonium thiosulfate (750 g/mL) | 107 mL | 214 mL |
| Succinic acid | 29.5 g | 59.0 g |
| Ammonium iron(III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium bisulfite | 23.1 g | 46.2 g |
| Water | to make 1000 mL | 1000 mL |
| pH (at 25° C./regulated by nitric acid or aqueous ammonia) | 6.00 | 6.00 |

-continued

| | [Tank solution] | [Replenisher] |
|---|---|---|
| [Rinse solution] | | |
| Sodium chlorinated isocyanurate | 0.02 g | 0.02 g |
| Deionized water (conductivity: 5 μS/cm or less) | To make 1000 mL | To make 1000 mL |
| pH (at 25° C.) | 6.5 | 6.5 |

The yellow color forming density of each sample after processing was measured and a characteristic curve of exposure to high illumination for $10^{-6}$ sec was obtained. The sensitivity was defined by the reciprocal of an exposure amount giving a color forming density higher by 1.5 than the minimum color forming density and it was expressed by a value relative to the sensitivity of the sample 201 set at 100. From an inclination of a line connecting the point showing the density of 1.5 and the point showing the density of 2.0, gradation was determined.

The results are shown in Table 5.

TABLE 5

| Sample No. | Minimum color-forming density | Sensitivity | Gradation |
|---|---|---|---|
| 201 | 0.072 | 100 | 100 |
| 202 | 0.070 | 102 | 112 |

As is apparent from the results of Table 5, the sample 202 containing the emulsion of the present invention in its blue-sensitive layer has a high contrast.

Example 4

Image formation with the sample of Example 3 was conducted by laser scanning exposure.

As laser light sources, used were a light of 473 nm taken out by converting, by an SHG crystal of $LiNbO_3$ having a reversal domain structure, the wavelength of a YAG solid laser (oscillating wavelength; 946 nm) using as an exciting light source a semiconductor laser GaAlAs (oscillating wavelength; 808.5 nm); a light of 532 nm taken out by converting, by an SHG crystals of $LiNbO_3$ having a reversal domain structure, the wavelength of a YVO4 solid laser (oscillating wavelength; 1064 nm) using as an exciting light source a semiconductor laser GaAlAs (oscillating wavelength; 808.7 nm); and AlGaInP (oscillating wavelength; 680 nm: type No. LN9R20, made by Matsushita Electric Industrial Co., Ltd.). The scanning exposure was successively effected in such a manner that the three color laser beams could move successively vertically to the direction of the scanning, through respective rotating polygon mirrors. The temperature of the semiconductor laser was kept using a Peltier device to prevent the quantity of light from being changed depending on the temperature. Effective beam diameter was 80 μm; scanning pitch was 42.3 μm (600 dpi); and average exposure time per one pixel was $1.7\times10^{-7}$ sec.

After exposure, color development processing B was conducted, revealing that similar to the results of exposure to a high illumination light in Example 3, Sample 202 of the present invention exhibited a high contrast in the image formation using a laser scanning exposure.

Example 5

By employing the tabular grain emulsion prepared according to the present invention instead of Emulsion R used for the reversal color photosensitive material (101) described in Example of Japanese Patent Application (Laid-Open) No.2000-305219 and Emulsion Q used for the reversal color photosensitive material described in Example 5 of Japanese Patent Application 2001-378886, a reversal color photosensitive material having a high contrast could be obtained.

EFFECT OF THE INVENTION

The silver halide photographic emulsion comprising the tabular grains having a high aspect ratio and the narrow grain size distribution can be obtained by the process for producing the silver halide emulsion according to the present invention.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide emulsion, which comprises disposing a mixer equipped with a first channel and a second channel brought into partial contact therewith; and allowing a silver salt solution (Fluid 1) and a halide solution (Fluid 2) to pass through said first channel and said second channel, respectively, to thin said two fluids into lamellae having an open interface therebetween and having a thickness of 1 to 500 $\mu$m in a normal line direction on the contact interface, thereby inducing diffusion, transfer and reaction of silver ions and halogen ions between said two thin layers, and thus forming silver halide grains continuously.

2. The process as in claim 1, wherein said first channel and said second channel are disposed in parallel and alternately and the number of said channels is 3 or greater.

3. A process for preparing a silver halide emulsion, which comprises feeding a fine-grain silver halide emulsion prepared by a process as claimed in claim 1 to a reaction vessel for causing nucleation and/or grain growth, and thereby causing nucleation and/or grain growth in the reaction vessel.

4. A process for preparing a silver halide emulsion, which comprises disposing at least one mixer as claimed in claim 1 in a circulating loop for circulating a dispersion medium solution in a reaction vessel to the reaction vessel and outside the reaction vessel, and charging a silver salt solution and/or a halogen salt solution in the mixer, thereby inducing nucleation and/or grain growth.

5. The process as in claim 3, wherein the silver halide emulsion comprises tabular grains having an aspect ratio of 5 or greater.

* * * * *